US011562724B2

(12) United States Patent
Unruh et al.

(10) Patent No.: US 11,562,724 B2
(45) Date of Patent: Jan. 24, 2023

(54) WIND NOISE MITIGATION SYSTEMS AND METHODS

(71) Applicant: Knowles Electronics, LLC, Itasca, IL (US)

(72) Inventors: Andrew D. Unruh, San Jose, CA (US); Thomas E. Miller, Itasca, IL (US); Aidan Meacham, Itasca, IL (US)

(73) Assignee: Knowles Electronics, LLC, Itasca, IL (US)

( * ) Notice: Subject to any disclaimer, the term of this patent is extended or adjusted under 35 U.S.C. 154(b) by 297 days.

(21) Appl. No.: 17/002,780

(22) Filed: Aug. 26, 2020

(65) Prior Publication Data

US 2021/0065670 A1 Mar. 4, 2021

Related U.S. Application Data

(60) Provisional application No. 62/891,796, filed on Aug. 26, 2019.

(51) Int. Cl.

| | |
|---|---|
| ***G10K 11/00*** | (2006.01) |
| ***H04R 3/00*** | (2006.01) |
| ***G10L 21/0208*** | (2013.01) |

(52) U.S. Cl.

CPC ..... *G10K 11/002* (2013.01); *G10L 21/0208* (2013.01); *H04R 3/005* (2013.01); *H04R 3/007* (2013.01); *H04R 2410/05* (2013.01); *H04R 2410/07* (2013.01)

(58) Field of Classification Search

None

See application file for complete search history.

(56) References Cited

U.S. PATENT DOCUMENTS

| | | | | |
|---|---|---|---|---|
| 9,516,408 | B2 * | 12/2016 | Zakis | H04R 3/005 |
| 10,916,249 | B2 * | 2/2021 | Han | G10L 25/84 |
| 11,102,569 | B2 * | 8/2021 | Okuda | H04R 3/04 |

* cited by examiner

*Primary Examiner* — Paul W Huber

(74) *Attorney, Agent, or Firm* — Loppnow & Chapa; Matthew C. Loppnow

(57) ABSTRACT

A system and method can provide nose, such as wind noise, mitigation and/or microphone blending. Some methods may include sampling a sound signal from a plurality of microphones to generate a frame comprising a plurality of time-frequency tiles of the sound signal, each time-frequency tile including respective values of at least one feature from the plurality of microphones, comparing the respective values of the at least one feature to determine whether each time-frequency tile satisfies a similarity threshold, and flagging each time-frequency tile as noise if it fails to satisfy the similarity threshold, grouping the plurality of time-frequency tiles into sets of frequency-adjacent time-frequency tiles, and for each set of frequency-adjacent time-frequency tiles in the frame: counting a number of flagged time-frequency tiles, and attenuating all of the time-frequency tiles in the each set if the number exceeds a noise bin count threshold to thereby reduce noise in the sound signal.

10 Claims, 16 Drawing Sheets

WIND NOISE MITIGATION SYSTEMS AND METHODS

TECHNICAL FIELD

This application relates generally to audio processing and more particularly to systems and methods for wind noise mitigation.

BACKGROUND

A voice controlled user interface of a communication or other audio device may activate in response to a user speaking a keyword and may accept spoken commands after activation. However, the user may utilize the voice controlled user interface in a variety of different contexts, including contexts with wind noise. There remain challenges associated with distinguishing sounds associated with voice control inputs of a user in the presence of other sounds such as wind noise. The undesired portion of sounds input to the device, such as wind noise, may reduce the intelligibility of the desired portion of sounds input to the device, such as voice control inputs from a user, rendering the voice control input speech difficult or impossible to decipher.

Accordingly, there remains a need for a mechanism to ameliorate the effects of the undesired portion of sound inputs received by a microphone or other audio device (e.g., wind noise) on the intelligibility of a desired portion of such sound inputs (e.g., user speech).

BRIEF DESCRIPTION OF THE DRAWINGS

For a more complete understanding of the disclosure, reference should be made to the following detailed description and accompanying drawings wherein.

SUMMARY

Figure 1:
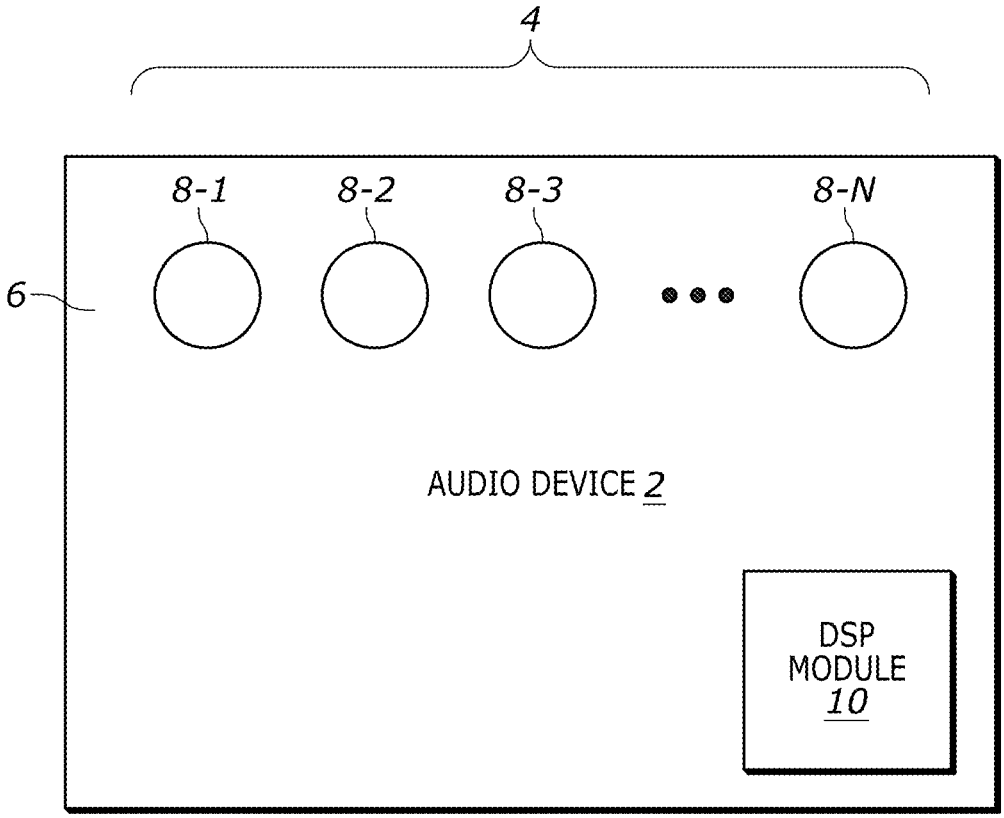
FIG. 1 depicts an example audio device having a wind noise mitigation system, in accordance with various embodiments.

A system and method provides for mitigating noise such as wind noise. Some embodiments include methods for multi-stage comparison masking. Such methods may include sampling a sound signal from a plurality of microphones to generate a frame comprising a plurality of time-frequency tiles of the sound signal, each time-frequency tile including respective values of at least one feature from the plurality of microphones, comparing the respective values of the at least one feature to determine whether each time-frequency tile satisfies a similarity threshold, and flagging each time-frequency tile as noise if it fails to satisfy the similarity threshold, grouping the plurality of time-frequency tiles into sets of frequency-adjacent time-frequency tiles, and for each set of frequency-adjacent time-frequency tiles in the frame: counting a number of flagged time-frequency tiles, and attenuating all of the time-frequency tiles in the each set if the number exceeds a noise bin count threshold to thereby reduce noise in the sound signal.

These and other embodiments may include methods of microphone blending. Such methods may include sampling a sound signal from a plurality of microphones to generate a frame comprising a plurality of time-frequency tiles of the sound signal, equalizing a speech component in each time-frequency tile across the microphones, estimating cross and auto spectral densities in each equalized time-frequency tile for the plurality of microphones, using the cross and auto spectral densities to estimate the noise levels for each microphone for each time-frequency tile, and assigning respective gains for the plurality of microphones based on the estimated respective noise levels for each time-frequency tile so as to minimize the contribution of noise to the output while preserving the speech.

Further embodiments include systems for wind noise mitigation. Such systems may include a plurality of microphones, including at least a first sub-plurality of microphones and a second sub-plurality of microphones, a first module configured to process signals from the first sub-plurality of microphones and to generate a first output, the first module comprising one of a comparison masking (CM) module or an optimal microphone blending (OMB) module, a second module configured to process signals from the second sub-plurality of microphones and to generate a second output, and a third module configured to process the first and second outputs and to generate a wind noise reduced output.

DETAILED DESCRIPTION

Skilled artisans will appreciate that elements in the figures are illustrated for simplicity and clarity. It will further be appreciated that certain actions, blocks, and/or steps may be described or depicted in a particular order of occurrence while those skilled in the art will understand that such specificity with respect to sequence is not actually required. It will also be understood that the terms and expressions used herein have the ordinary meaning as is accorded to such terms and expressions with respect to their corresponding respective areas of inquiry and study except where specific meanings have otherwise been set forth herein.

According to certain general aspects, the present embodiments are directed to systems and methods for wind noise mitigation. A wind noise mitigation system may be implemented to facilitate the abatement of missed keywords as well as the abatement of false activation of a host device in connection with keywords falsely detected by microphones. For example, an electronic device may take action in automatic response to receipt of a spoken keyword. The wind noise mitigation system improves the ability to detect desired keywords in noisy environments where a challenging signal-to-noise ratio may otherwise hamper user efforts to control a machine interface.

In addition, the wind noise mitigation system improves a user's experience when capturing audio having both desired and undesired components (e.g., wind noise). For example, a microphone array of a headset, hearing aid, or other human interface may be afflicted with undesired wind noise. By including a system and method for wind noise mitigation, the signal to noise ratio of the electronic signal representing the sounds detected by the microphones may be improved. By improving the signal to noise ratio of the desired component relative to the wind noise, intelligibility of the detected sounds from a human user is enhanced and user fatigue is diminished.

Thus, headphones, headsets, hearing aids, and/or other user interface devices may implement the wind noise mitigation system to improve user experiences. Voice controlled systems and devices may implement the wind noise mitigation system to improve the ability to detect desired keywords in noisy environments where a challenging signal-to-noise ratio may otherwise hamper efforts to trigger an activation event in response to a spoken keyword or may otherwise hamper machine recognition of spoken commands.

Past efforts to address wind noise include undesirable and bulky wind screens on microphones or software processing solutions that compare multiple microphone inputs and cancel uncorrelated sounds such as wind noise and preserve correlated sounds, such as speech. However, such software solutions may, in various instances, also preserve wind noise because wind noise may, from time to time, appear momentarily correlated.

Systems and methods of wind noise mitigation are provided to address these concerns. In various embodiments, and discussed further below, it has been determined that wind generates relatively uncorrelated sound whereas speech generates relatively correlated sound when detected at a plurality of spaced microphones across a housing. The spaced microphones receive both an undesired component of a sound, such as wind noise, and a desired component of the sound, such as speech. The speech is correlated and the wind is uncorrelated at the spaced microphones. However, from time to time, wind noise may exhibit momentary correlated behavior by happenstance. Embodiments presented herein address this anomalous behavior and improve amelioration of unwanted wind noise.

In past systems, grills of cloth, plastic, or metal have been used to extend over a microphone to protect the microphone from fingers, dirt, and wind; such mesh or grid material includes very closely spaced openings. These grills fail to provide sufficient beneficial attenuation of uncorrelated noise discussed herein. In general, as air flows across a surface, turbulence and whirling or traveling vortices resulting from the turbulence create random fluctuations in air pressure across that surface. Consequently, uniquely varying air pressure patterns emerge occurring at each point along the surface. In contrast, as speech travels to a microphone, the speech proceeds relatively unaffected by wind and alterations in local sound pressure caused by reflections from nearby objects generally create stationary (e.g., not fluctuating) changes in loudness and phase as the sound reaches the surface, but does not generally create variations in correlation relative to other points across the surface. Consequently, by providing spaced microphones and implementing systems and methods for wind noise mitigation with such microphones, wind noise may be identified and ameliorated. While the terms "correlated" and "uncorrelated" are used above, one may also appreciate that the sounds may be characterized by level and phase. For instance, the speech generates sound with relatively the same level at points across the surface and relatively the same phase at points across the surface. For example, within a given FFT frequency band, wind will often create momentary level differences greater than 6 dB and phase differences greater than 40 degrees between microphone locations, while speech will often have differences of less than 2 dB and 10 degrees (perhaps dependent on frequency) at those same locations.

With reference to FIG. 1, in various embodiments, an audio device 2 may include a microphone array 4. The microphone array 4 may include a plurality of spaced apart microphones spaced apart on a housing 6 of the audio device 2. For example, a microphone array 4 may include a first microphone 8-1, a second microphone 8-2, a third microphone 8-3 and any number 'n' of microphones, such as an $N^{th}$ microphone 8-N.

The audio device 2 may include a digital signal processing module 10. The digital signal processing module 10 may implement a variety of techniques for wind noise mitigation. These techniques may be performed in parallel and/or in series. Moreover, various different techniques may be performed on audio signals from the different microphones of the microphone array 4. In further instances, the same techniques are performed on the audio signals from the different microphones of the microphone array 4. These different techniques for wind noise mitigation will be discussed further herein and can be combined in different sequences together, as also will be described. Thus, one will appreciate that techniques provided herein may be implemented individually or collectively, and may be combined in different sequences.

Comparison Masking

Among systems and methods of wind noise mitigation, one technique comprises comparison masking. A comparison mask refers to an algorithmic utilization of sound captured from a plurality of microphones to separate speech or other desired sound components from wind noise. Because speech is more highly similar between microphone locations than wind noise, by measuring the degree of similarity of sound components, and comparing the measured degree of similarity to a threshold, desired sound components and wind noise may be distinguished and the wind noise may be attenuated relative to the desired sound components. More specifically, a comparison of amplitude and phase of the different sound components at different microphones may be performed. The amplitude and the phase may satisfy the threshold if the differences in amplitude and phase from one microphone to another microphone are less than the threshold. Desired sound components will exhibit relatively similar amplitude and relatively similar phase at multiple spaced apart microphones on a housing 6, whereas wind noise, due to the uniquely varying air pressure patterns mentioned above, will exhibit varying amplitude and varying phase from microphone to microphone.

Thus, a received sound signal detected at a plurality of microphones may be processed to detect components of the sound signal that are relatively similar at at least two microphones and components of the sound signal that are relatively dissimilar at at least two microphones. By attenuating the components of the sound signal in which similarity among microphones fails to satisfy a threshold, but not attenuating the components of the sound signal in which similarity among microphones does satisfy a threshold, those components corresponding to wind noise may be attenuated relative to those components corresponding to speech.

However, in various instances, a received sound signal may have both wind noise and speech. Moreover, in various instances, a received sound signal may have wind noise that, due to random coincidence, momentarily exhibits apparent similarity due to the random fluctuations in air pressure across the different microphones instantaneously exhibiting momentary similarity. For instance, from time to time, levels and phase may be the same or may be within a threshold of each other, as measured between different microphones. Failing to attenuate the wind noise that momentarily exhibits apparent similarity causes tonal noise artifacts, as unattenuated wind noise is momentarily passed at full volume through the comparison mask.

Comparison Masking (CM)—Phase 1

Figure 2:
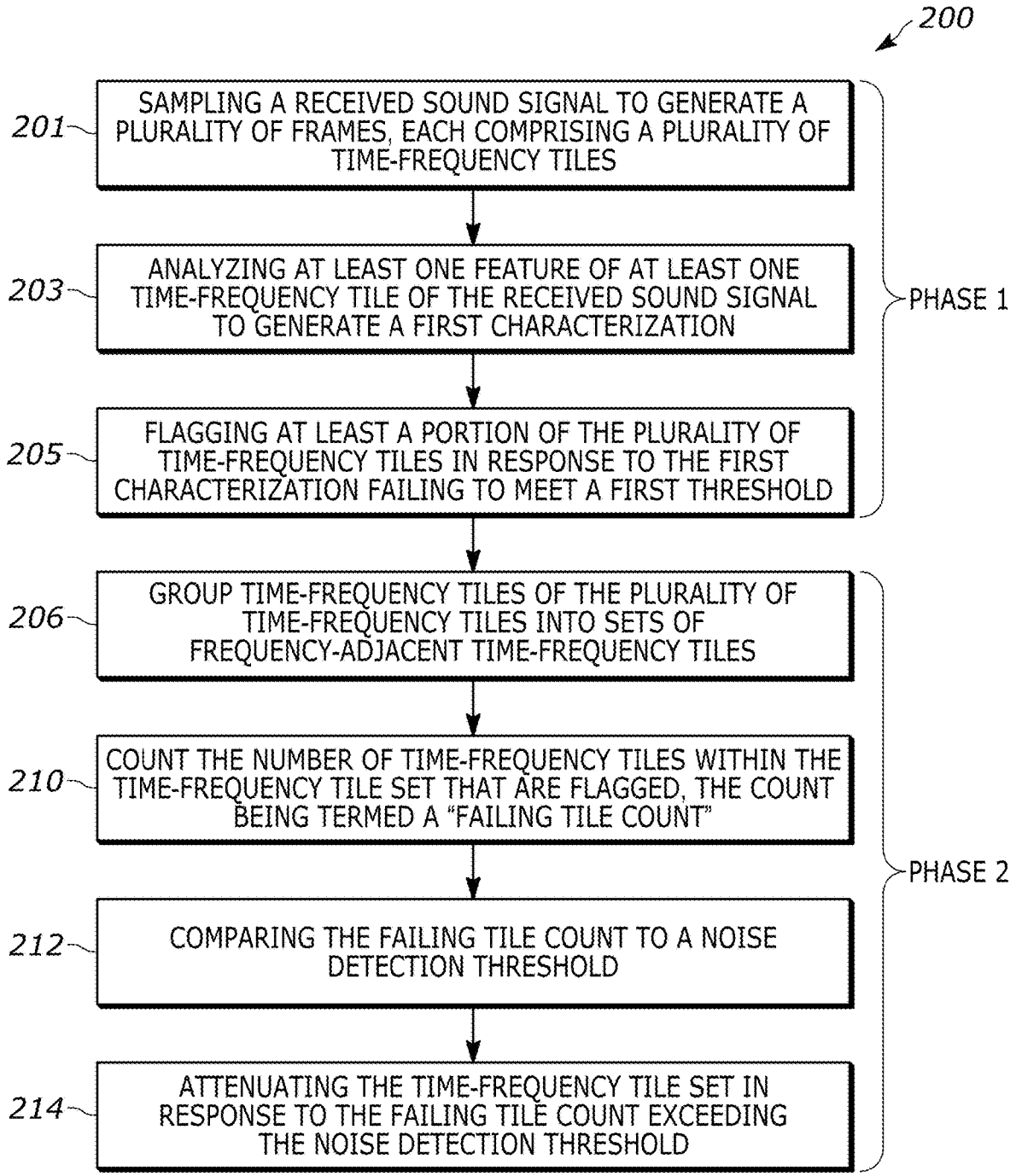
FIG. 2 depicts an example method of wind noise mitigation, in accordance to various embodiments.
Figure 21A:
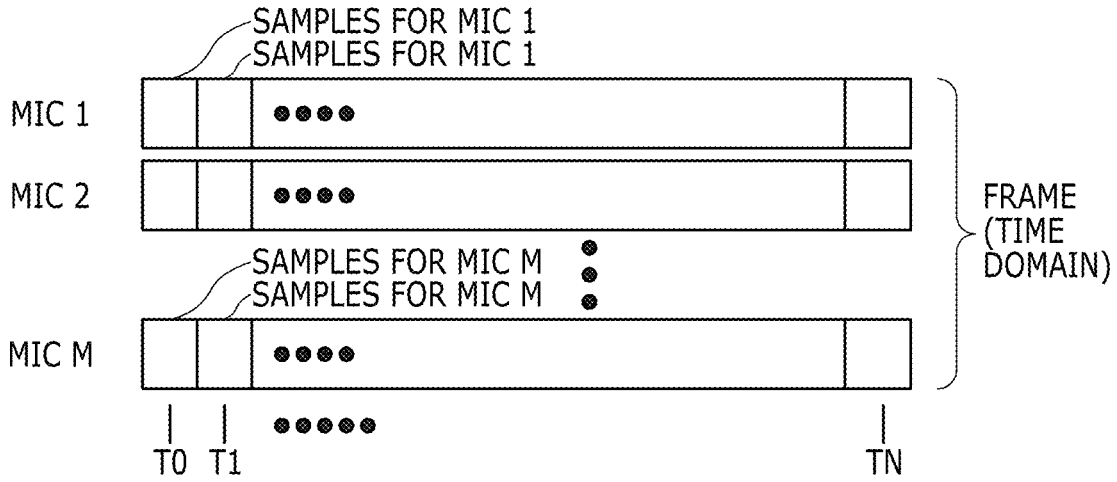
FIGS. 21A-C are diagrams illustrating aspects of time-frequency tiles and frames according to embodiments.
Figure 21B:
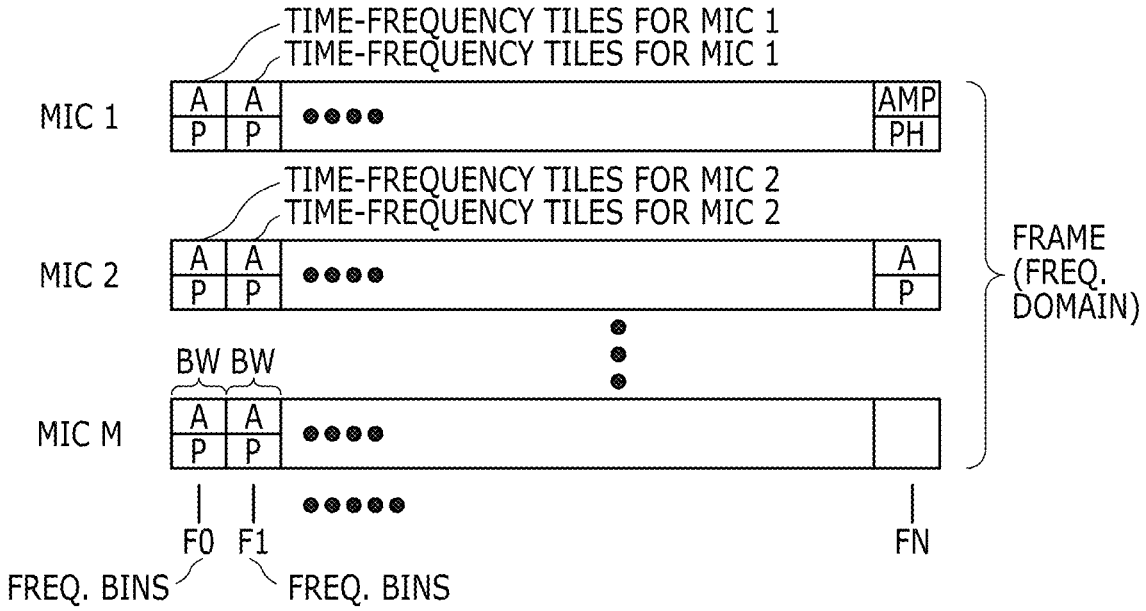

A novel multi-stage comparison masking method overcomes this challenge. For example, with reference to FIG. 2, a multi-stage comparison masking method 200 may comprise sampling a received sound signal comprising sound from a plurality of microphones to generate a plurality of frames (block 201) in the time domain as shown in FIG. 21A. The samples may be gathered into overlapping frames and converted into the frequency domain using the fast Fourier transform (FFT) following well-known signal processing practices. Once converted to frequency domain, each frame contains a plurality of frequency bins, as shown in FIG. 21B. Each frame contains signals from multiple different microphones as shown in FIGS. 21A and 21B. Operations to be described later may be applied to this frequency domain representation of the signal to reduce the unwanted noise. After all signal processing has been completed, an inverse FFT may be applied to restore the signal to the time domain, and the frames may be reconstructed into a continuous time domain signal using the well-known overlap-add method.

The contents of each frequency bin with a frame represents the signal within a narrow frequency range and within a short segment of time. Such a segment will here forward be referred to as a time-frequency tile. Accumulating tiles of all frequencies over all frames allows one to completely reconstruct the original signal.

As mentioned, in a frequency domain, a frame is subdivided into multiple frequency bins. A frequency bin having a temporal length (e.g. T0 to TN) of one frame may be termed a time-frequency tile. A frequency bin and/or a time-frequency tile may comprise a representation of a subset of the bandwidth of the frame. Thus a frame may include many time-frequency tiles that are temporally overlapping and/or simultaneous. Stated differently, many frequency bins are collected at a same temporal position, each frequency bin associated with a time-frequency tile or segment of the frame, the time-frequency tile or segment having a center frequency (e.g., f0, f1, etc.) and a bandwidth.

The method may further include analyzing at least one feature of at least one time-frequency tile of at least one frame of the plurality of frames (block 203). Such analysis may provide a first characterization of a sound component of the time-frequency tile (block 205). Moreover, analyzing at least one feature may include comparing at least one feature of a first frame to at least one feature of a second frame. Yet furthermore, analyzing at least one feature may include comparing at least one feature of the first frame, such as a signal from a first microphone contributing to the first frame, with at least one further feature of the first frame, such as a signal from a second microphone contributing to the first frame.

In various embodiments, the features that are compared may be time-frequency tiles. Specifically, one or more time-frequency tile of the first frame may be compared to one or more time-frequency tile of the second frame.

In further examples, analyzing at least one feature of at least one time-frequency tile may include comparing phase and amplitude values between two or more microphones within one tile, allowing characterization of the tile as being an unwanted component (e.g., noise) or a wanted component (e.g., speech).

For example, as measured between the values of a given time-frequency tile from the two microphones, the amplitude and phase of a wanted component differ less than the amplitude and phase of an unwanted component (e.g., wind noise), because wind noise is typically dissimilar at different locations of different microphones on the housing, whereas speech is typically similar. In various embodiments, the determination of similarity may comprise a calculation of a cross correlation between the values of amplitude and/or phase of a given time-frequency tile. In another example embodiment, the phase and/or amplitude values for a given time-frequency tile from a first microphone and a second microphone are compared, and the difference between the values is compared to a similarity threshold. In some embodiments, the similarity threshold for amplitude is around 3 dB. In these and other embodiments, the similarity threshold for phase is around 15 degrees. In yet further embodiments, the similarity thresholds for amplitude and phase are adjustable by a user.

In various embodiments, time-frequency tile(s) that exhibit dissimilar behavior relative to at least a portion of the other time-frequency tile(s) may be flagged as noise. Stated differently, time-frequency tile(s) that fail to achieve a first similarity threshold may be flagged, whereas time-frequency tile(s) that do achieve the first similarity threshold are not flagged. Stated yet another way, at least a portion of the plurality of time-frequency tiles are flagged in response to the first characterization failing to reach a first threshold (block 205). In various embodiments, flagged time-frequency tiles are subsequently attenuated. It should be noted that an appropriate threshold can be determined by measuring sound examples that are known to be speech and others that are known to be noise, and noting the difference in similarity between microphones.

Comparison Masking (CM)—Phase 2

In further embodiments, rather than merely attenuating time-frequency tiles failing to achieve a similarity threshold (flagged time-frequency tiles), a second phase is performed.

In some embodiments, each non-flagged time-frequency tile is further analyzed to determine presence or absence of desired sound components, such as speech. In response to speech components being absent from the non-flagged time-frequency tile, the non-flagged time-frequency tile is flagged, regardless of apparent similarity or dissimilarity. Subsequently, all flagged time-frequency tiles are attenuated. In this manner, momentary apparently similar wind noise present in non-flagged time-frequency tiles is also attenuated so that tonal noise artifacts are not passed at full volume through the similarity masking method. Notably, by expanding the potential attenuation to additional time-frequency tiles, as described in more detail below, not flagged as containing noise, signal to noise ratio is improved and speech intelligibility is also preserved.

Figure 21C:
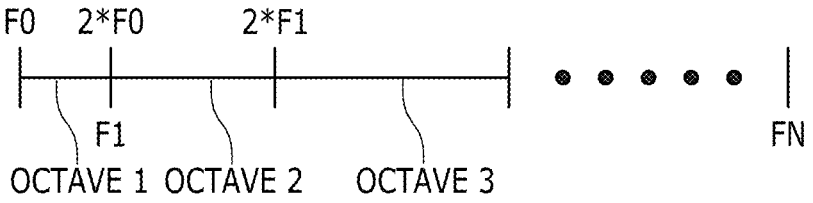

In various embodiments, rather than attenuating time-frequency tiles on the individual time-frequency tile by time-frequency tile basis, time-frequency tiles are grouped into sets of frequency-adjacent time-frequency tiles within a frame (block 206). For example, time-frequency tiles may be collected into sets that have a collective bandwidth of about one octave. The concept of octaves is illustrated in FIG. 21C. As shown, the frequency value of a first bin in Octave 2 is twice the frequency value of a first bin in Octave 1, and so on. Thus, a plurality of sets of time-frequency tiles, each set comprising a bandwidth of one octave, are generated from the plurality of time-frequency tiles. The number of time-frequency tiles within the one octave that fail to achieve a first similarity threshold are counted.

In any event, the method includes counting the number of time-frequency tiles within the time-frequency tile set that are flagged (e.g., associated with a first characterization failing to meet the first threshold) (block 210). This count is referred to as a failing tile count.

The failing tile count is compared to a preset threshold (the "noise bin count") (block 212). In this regard, it should be noted that the preset threshold (i.e. "noise bin count") may be different for each octave or set. In response to the failing tile count within the time-frequency tile set exceeding the noise detection threshold, the time-frequency tile set is determined to contain an excessive amount of undesired sound components (e.g., noise). As such, the entire time-frequency tile set is attenuated, including those time-frequency tiles that individually are not flagged as noise, and thus are not associated with a first characterization failing to meet the first threshold.

In various embodiments, the time-frequency tile set comprises a collection of time-frequency tiles with a collective bandwidth of one octave. By operating to attenuate or not attenuate sound components at the octave-by-octave level, rather than at the tile-by-tile level, momentary bursts of noise associated with an occasional time-frequency tile having noise that exhibits apparently similar behavior may be ameliorated. Such occasional time-frequency tiles will likely also be attenuated because adjacent time-frequency tiles within the octave will exhibit sufficient dissimilar behavior that the entire octave will be attenuated. Similarly, by operating to attenuate or not attenuate sound components at the octave-by-octave level, rather than at the tile-by-tile level, octaves containing a significant amount of speech, relative to noise, will not be attenuated. By operating at the octave-by-octave level, occasional, isolated noisy tiles within the octave otherwise containing a significant amount of speech, will also not be attenuated. This will enhance the quality of the speech by refraining from attenuating occasional noisy tiles that may also have speech elements. Thus, the creation of digital artifacts that may harm the intelligibility of speech is also diminished. In various embodiments, attenuated tiles may be attenuated approximately 20 dB, or 30 dB, or discarded (muted) completely, or may be attenuated to a different degree.

Figure 3A:
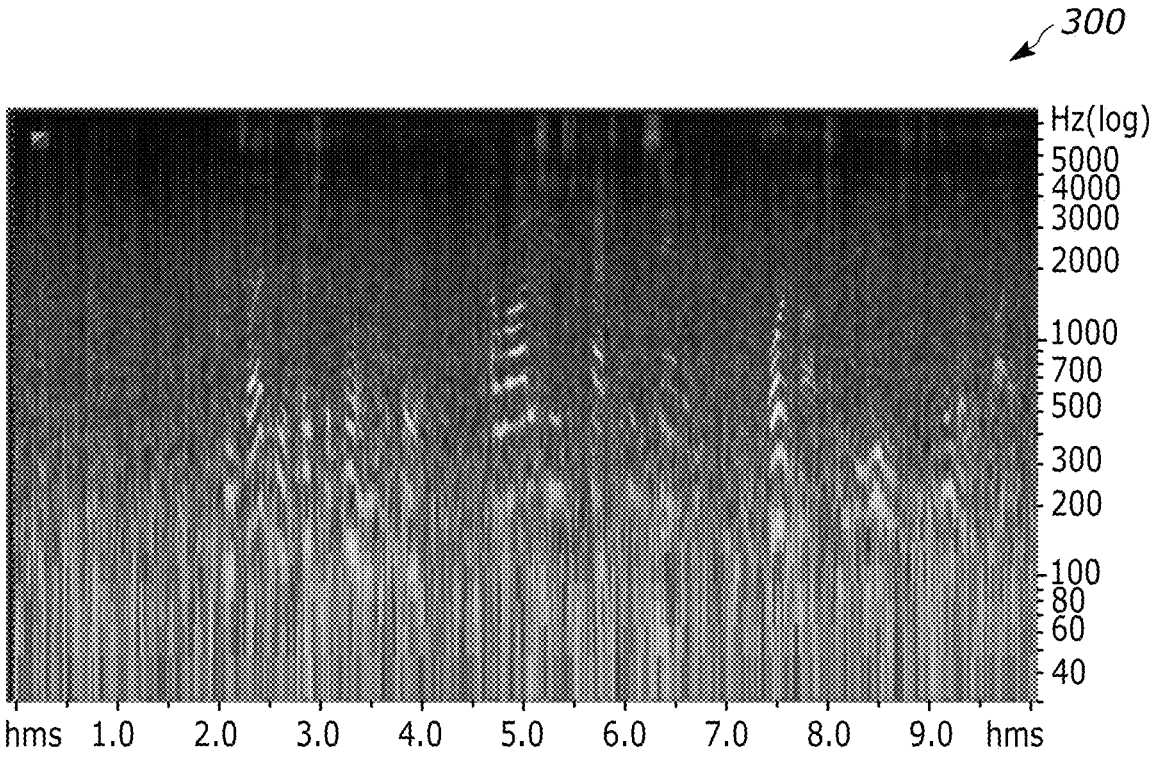
FIGS. 3A-C depict example spectrograms showing the wind noise mitigating functionality of the method according to FIG. 2 at various points in the method.
Figure 3B:
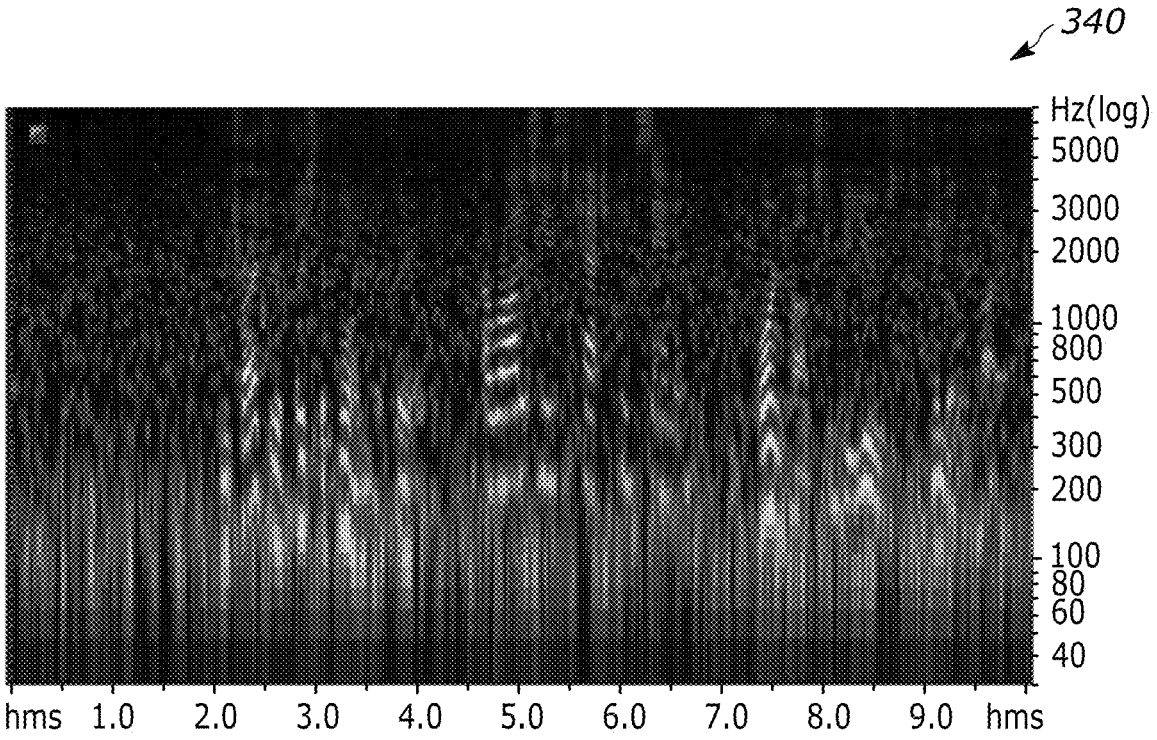
Figure 3C:
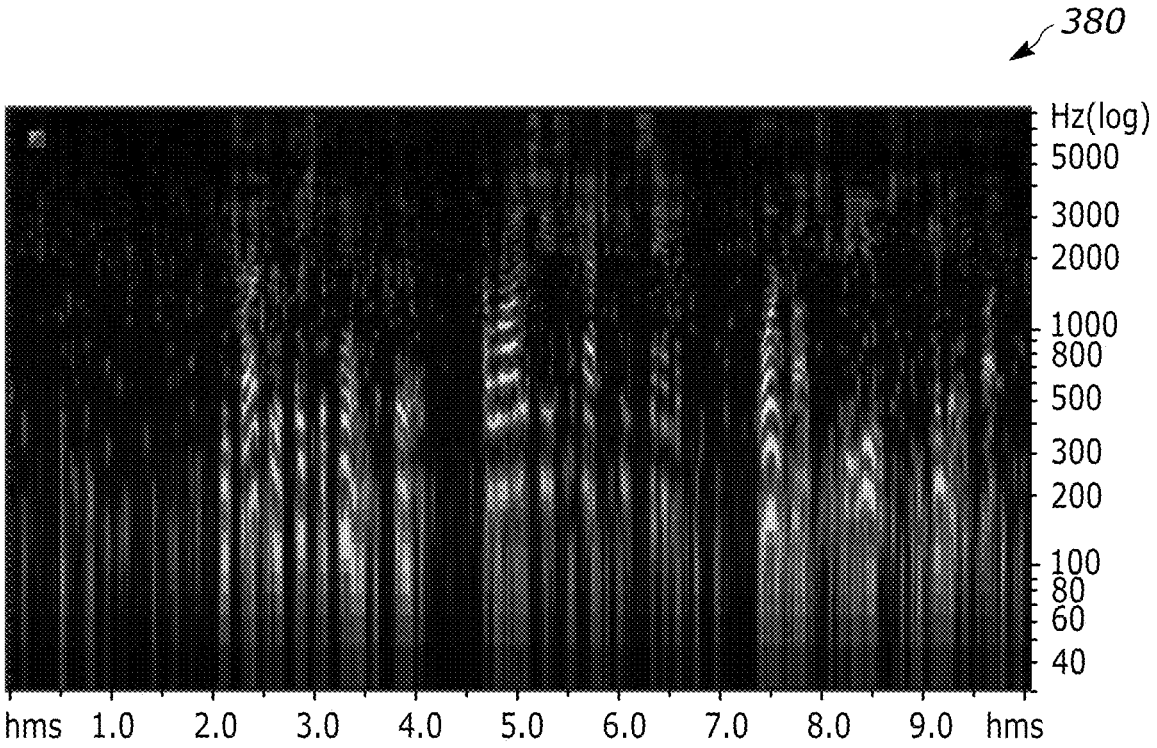

A series of three spectrograms are presented to demonstrate the multi-stage comparison masking method 200. With reference to FIGS. 3A-3C, a series of spectrograms are depicted representing collections of time-frequency tiles at different points in the method. For example, FIG. 3A shows an unprocessed spectrogram 300 depicting the combination of desired and undesired sound components in a received sound signal. Significant "speckling" throughout the spectrogram obscures speech components. FIG. 3B shows a partially processed spectrogram 340 depicting a received sound signal after processing through the conclusion of block 205, wherein flagged time-frequency tiles have been attenuated at the conclusion of comparison masking—phase 1. FIG. 3C shows a fully processed spectrogram 380 depicting a received sound signal after processing through the conclusion of block 212, wherein flagged time-frequency tiles have been attenuated at the conclusion of comparison masking—phase 2. Notably, minimal "speckling" is depicted and speech components are clearly depicted as collections of sound, the duration of which are shown on the X-axis and the frequency of which are shown on the Y-axis. More particularly, the example of FIG. 3A shows many light colored random dots in between the larger patterns of light and dark that represent speech, while the example of FIG. 3C shows large dark areas between bands of light that indicate speech. Each light colored dot represents a brief burst of a tone. The aggregate effect of those dots is a highly unnatural "metallic" or "musical comb" sounding character for the sound of the background noise after processing. As shown in FIG. 3C this unwanted character is significantly reduced.

Optimal Microphone Blending (OMB)

Among systems and methods of wind noise mitigation according to embodiments, one technique comprises optimal microphone blending. Briefly stated, each microphone may have an associated optimal gain setting based on characteristics of the received sound components received at that microphone. By establishing the optimal gain at each microphone, the signal to noise ratio of received speech may be enhanced. Optimal microphone blending infers a relative level of noise and speech in each frame for each microphone. As mentioned previously, the sounds detected by a microphone may be divided into frames. Thus each microphone may be responsible for a set of frames. Some microphones, and thus some sets of frames may have more noise than others, and thus, by setting the gain for each microphone (e.g., each set of frames), noise may be ameliorated and the intelligibility of speech or other desired sound components may be enhanced.

Various mechanisms exist for determining the proper gain setting for each microphone. For example, for three or more microphones receiving dissimilar noise, the proper gain for each can be determined based on the amplitude of noise received by each microphone. In such case, the gain of each microphone is adjusted to correct for differences in the amplitudes of noise received by the different microphones so that each gain is adjusted to equalize the amplitudes and achieve a summed gain among all microphones summing to unity.

For microphones receiving a combination of dissimilar noise (undesired component) and a desired component such as speech, the amplitude of desired components (speech) are typically equal at each microphone, because desired components are typically similar, whereas the amplitude of undesired components (wind noise in particular, but necessarily all types of noise) are typically unequal at each microphone, because undesired components are typically dissimilar. The optimal gains for each microphone can be determined by minimizing the total amplitude of the combined output amplitude of a signal combining the contribution of each microphone, again, provided the summed gain across all microphones sums to unity. By achieving (1) minimal output amplitude and yet maintaining (2) a constant summed gain across all microphones (e.g., unity gain), the noise is minimized.

In further embodiments, an adaptive beamformer may further determine optimal gains for each microphone. For instance, an adaptive beamformer will adjust the gain for each microphone to steer a null and/or a peak, so that the null encompasses one or more source of undesired components (e.g., dissimilar components such as wind noise) and/or so that the peak encompasses one or more source of desired components (e.g., similar components such as speech).

Figure 4:
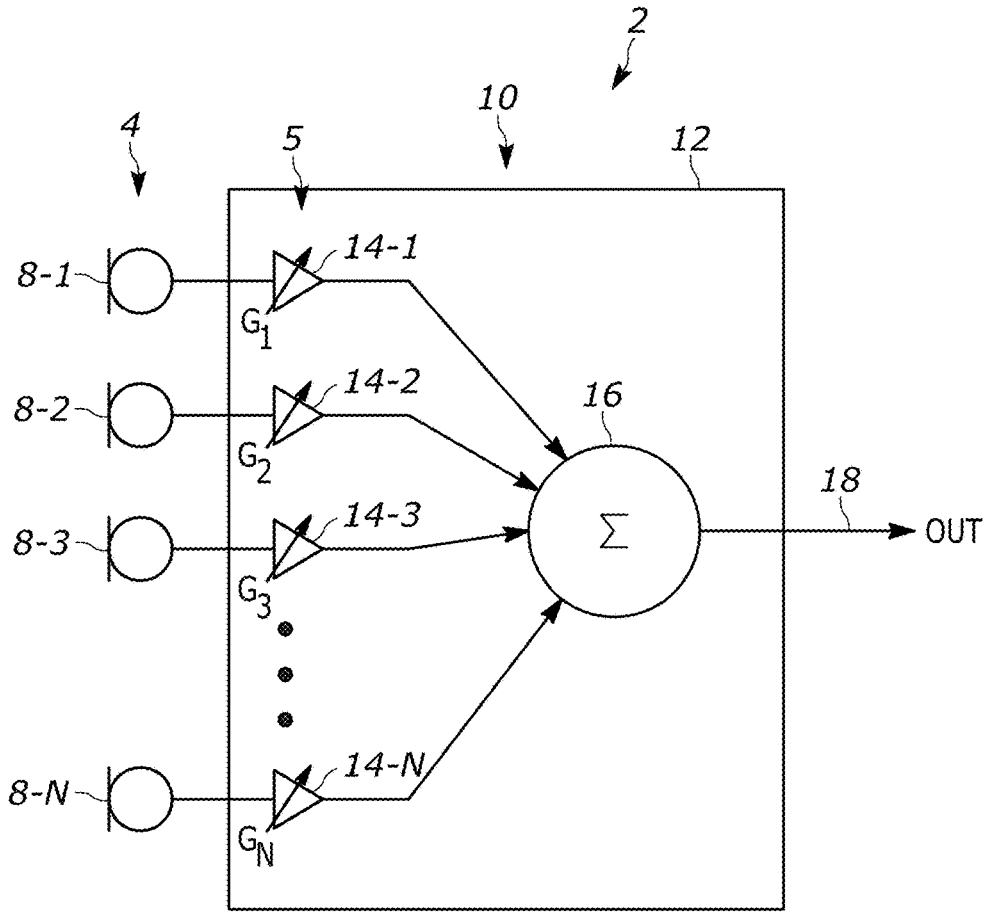
FIG. 4 depicts an example gain controller configured for implementation in a wind noise mitigation system, in accordance with various embodiments.

With reference to FIGS. 1 and 4, an audio device 2 may include a microphone array 4. The microphone array 4 may have a first microphone 8-1, a second microphone 8-2, a third microphone 8-3 and any number 'n' of microphones, such as a $N^{th}$ microphone, 8-N. Each microphone provides a microphone signal to the digital signal processing module 10, which contains a gain controller 12. The gain controller 12 comprises an amplifier array 5. The amplifier array 5 comprises a set of any number of amplifiers, each of which is connected to a microphone. For example, a first amplifier 14-1 may be connected to a first microphone 8-1, a second amplifier 14-2 may be connected to a second microphone 8-2, a third amplifier 14-3 may be connected to a third microphone 8-3, an $N^{th}$ microphone 8-N may be connected to an $N^{th}$ amplifier 14-N. The amplifiers may be adjustable so that the gain of each microphone is adjusted, provided the sum of the gains is constant (e.g., unity). Each amplifier is connected to a summation engine 16. The summation engine 16 combines the outputs of the amplifier to output a blended microphone signal 18.

In various embodiments, the gain controller 12 operates to perform a particular calculation, where G is the gain, S is the speech level, and N is the noise level. Specifically, the gain controller 12 sets the gain of each amplifier 14-1, 14-2, 14-3, and **14-*n*** according to the following calculation:

$$G_n = \frac{S_n / N_n^2}{\sum_{i=1}^{N} (S_i / N_i^2)}$$

The gain controller 12 arrives at the values for S and N through an estimation calculation. The estimation calculation proceeds according to the following principles. Wind noise between microphones is dissimilar and two dissimilar signals have a coherence of 0. Speech is similar and two similar signals have a coherence of 1.0. Assume the noise, N is dissimilar in first microphone 8-1 and second microphone 8-2. Then, the coherence between the two microphone signals will be:

$$C_{12} = \left(\frac{S_1^2}{S_1^2 + N_1^2}\right)\left(\frac{S_2^2}{S_2^2 + N_2^2}\right) \tag{1}$$

Where $C_{12}$ is the coherence between first microphone 8-1 signal and second microphone 8-2 signal. $S_L$ is the RMS speech level in first microphone 8-1 and $N_1$ is the RMS noise level in first microphone 8-1. Subscript 2 refers to the signals from second microphone 8-2. It should be understood that all of these are per frequency bin.

Now, to solve for S and for each microphone signal so that the mentioned calculation can be performed, further intermediate calculations are needed. In brief, the total levels are:

$$L_1^2 = S_1^2 + N_1^2 \tag{2}$$

$$L_2^2 = S_2^2 + N_2^2 \tag{3}$$

An independent measurement of coherence is provided as follows:

$$C_{12} = \frac{|S_{12}^2|}{S_{11} S_{22}} \tag{4}$$

Where $S_{12}$ is estimated cross-spectral density and $S_{11}$ and $S_{22}$ are the autospectral densities of microphones 1 and 2, respectively. It should be further noted that these values of S having two subscripts are distinct from the speech values S (represented above either alone or with a single sub script).

Because the signal levels are measurable, the above calculation may be performed to estimate coherence. Notably however, this gives three equations and four unknowns. Thus, one may perform a calibration (lab or in-situ) on the signals so that the speech is identical in both microphones and then replace S1 and S2 with just S. Of course, the wind noise will also be equalized. This gives:

$$C_{12} = \left(\frac{S'^4}{(S'^2 + N_1'^2)(S'^2 + N_2'^2)}\right) \tag{5}$$

Where the primes designate the equalized signal. Note that the coherence will be unaffected by the equalization. For the levels, there is now:

$$L_1'^2 = S'^2 + N_1'^2 \tag{6}$$

$$L_2'^2 = S'^2 + N_2'^2 \tag{7}$$

So now there are three equations and three unknowns.

Now, for optimal mic mixing, the gains on signals 1 and 2 will be, respectively:

$$g_1 = \frac{S' / N_1'^2}{S' / N_1'^2 + S' / N_2'^2} = \frac{N_2'^2}{N_1'^2 + N_2'^2} \tag{8}$$

$$g_2 = \frac{S' / N_2'^2}{S' / N_1'^2 + S' / N_2'^2} = \frac{N_1'^2}{N_1'^2 + N_2'^2} = 1 - g_1 \tag{9}$$

So, after optimal mic mixing, the level of the speech will be S (unchanged) and the level of the noise will be:

$$N = \sqrt{(g_1 N'_1)^2 + (g_2 N'_2)^2} \tag{10}$$

Figure 19:
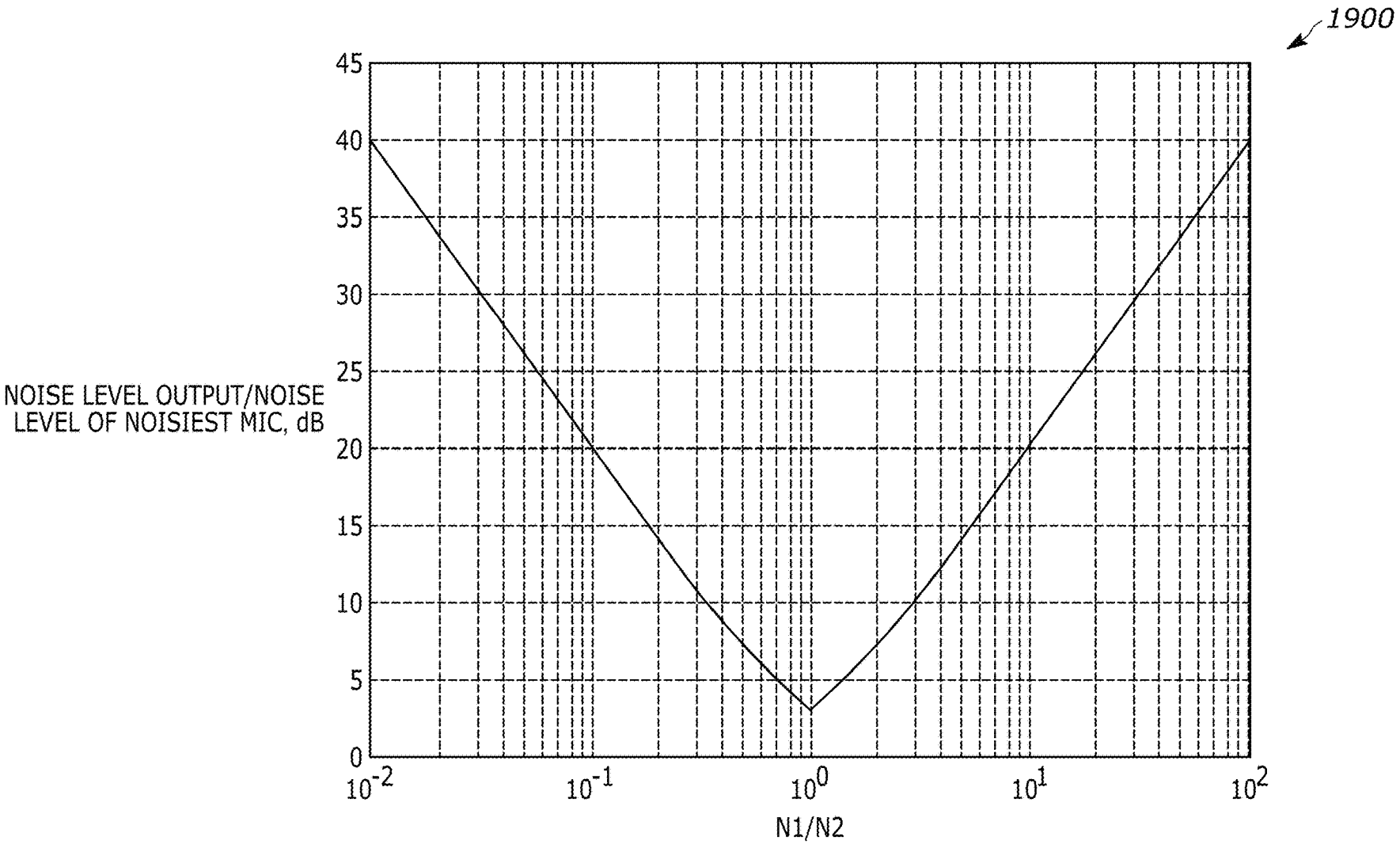
FIG. 19 depicts a plot showing a noise reduction associated with an optimal microphone blending technique, in accordance with various embodiments.

FIG. 19 provides a plot 1900 that shows the level of wind noise reduction as a function of $N'_1/N'_2$.

Coherence (e.g., similarity) is typically measured over an entire signal, as it is in the MatLab function mscohere. However, in a practical embodiment, estimates are implemented. Similarly, the amplitudes are estimated and rather than integrating for all time, a practical system should respond dynamically to varying conditions. Consequently, the time it takes the system to converge to a changing situation and accuracy is needed. In various embodiments, implementation of a leaky integrator effectuates such a compromise. Example MatLab code to effectuate a practical implementation including a leaky integrator is provided in Appendix A, the contents of which are incorporated herein by reference in their entirety.

Figure 20:
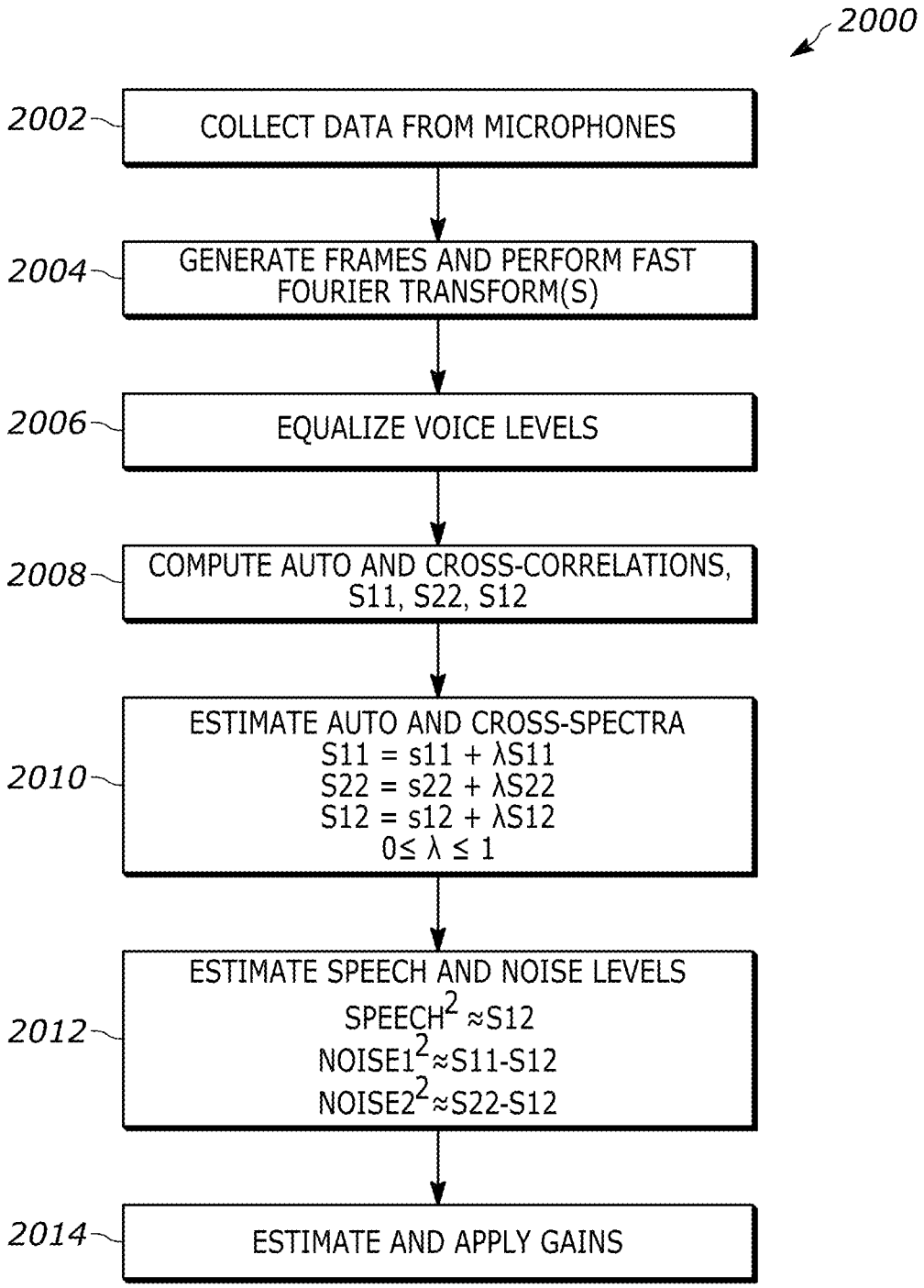
FIG. 20 depicts an example method of gain setting, in accordance with various embodiments.

With additional reference now to FIG. 20, one example method 2000 of gain setting by a gain controller 12 is provided as follows. In brief, the method includes adjusting a gain of each of two microphones while maintaining a constant summed gain of the two microphones, whereby the summed output amplitude of the two microphones is minimized. More specifically, the gain controller 12 receives data (e.g., signals) from the microphones (block 2002). In various embodiments, two microphones provide data. The gain controller 12 generates frames from the data and performs fast Fourier transforms on the frames, so that a frequency domain representation of the signals from the microphones is created (block 2004). The gain controller 12 amplifies or attenuates characteristics of one or more of the frequency domain representations of the signals so that the voice levels are equalized (block 2006). In this manner, the S1 and S2 values mentioned above can be estimated to be S (e.g., the same) so that fewer variables exist to be solved for. The method includes computing auto and cross correlations ($S_{11}$, $S_{22}$, $S_{12}$, note the lower case s to distinguish correlations from spectral densities (block 2008) and estimating auto and cross-spectra: $S_{11}=s_{11}+\lambda S_{11}$; $S_{22}=s_{22}+\lambda S_{22}$; $S_{12}=s_{12}+\lambda S_{12}$; $0\leq\lambda\leq1$ (block 2010). The method continues with estimating speech and noise levels: $SPEECH^2\approx S12$; $NOISE1^2\approx S11-S12$; and $NOISE2^2\approx S22-S12$ (block 2012). Consequently, the method may conclude with estimating and applying gains to the different signals from the different microphones (block 2014).

Figure 22:
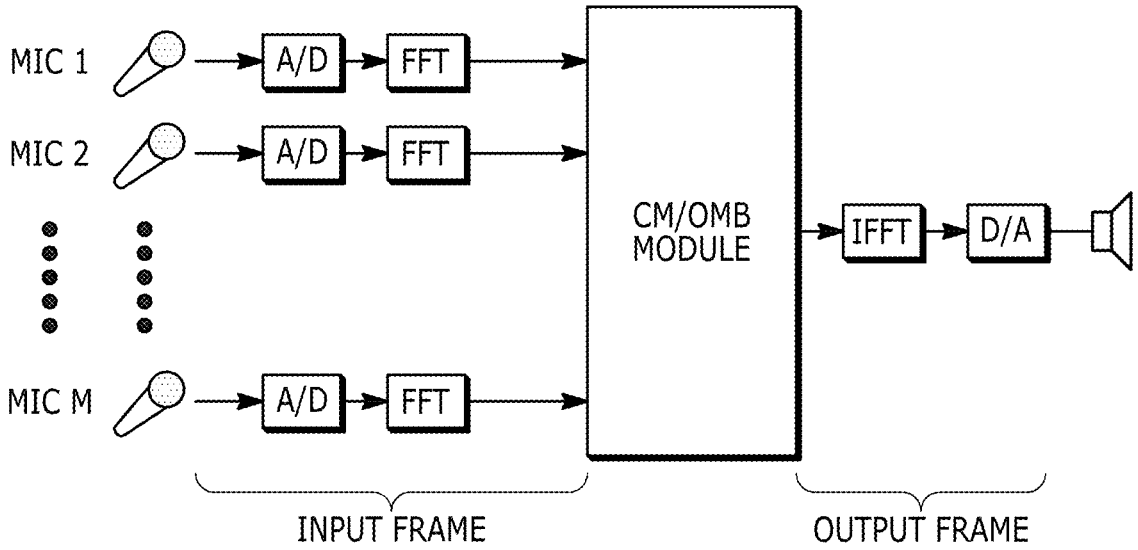
FIG. 22 is a block diagram illustrating aspects of frame-by-frame processing according to embodiments.

In various implementations, the processing performed in connection with comparison masking and/or optimal microphone blending as described above is performed on a frame-by-frame basis. Aspects of such implementations are depicted in FIG. 22. As shown, a sound is captured by a plurality of microphones Mic1 to MicM. The analog signals generated from each microphone are sampled and provided to an analog-to-digital converter. A set of digital samples (e.g. T1 to TN as shown in FIG. 21A) from all microphones corresponds to a single frame. The sets of samples for each microphone is converted to frequency domain representations (e.g. having amplitude and phase for each frequency bin f0 to fN as shown in FIG. 21B) by a FFT. These frequency domain representations from each microphone are provided to a module (e.g. firmware executing on a processor for implementing comparison masking or optimal microphone blending as described above). This processing results in a single aggregate output frame and converted back into the time domain by an inverse FFT, and then perhaps back to an analog signal for driving a loudspeaker. Alternatively, the output frame can be transmitted to other components or devices.

Inside/Outside Blending (IOB)

In various embodiments, novel and non-obvious optimal microphone blending and/or novel and non-obvious two-phase comparison masking is combined with further techniques, some of which are well-known in the art. For instance, inside/outside blending may be combined with CM or OMB. In various embodiments, IOB comprises mixing signals collected by microphones disposed inside a user's ear and/or inside an ear cup of a headset with signals collected by microphones that are not disposed inside the user's ear and are not inside an ear cup of a headset. For instance, microphones may be disposed on the outer housing, or disposed in communication with the air proximate to the outer housing of a device. The outputs of these multiple microphones may be blended according to well-known techniques in order to further mitigate deleterious wind noise.

Single Channel Noise Reduction (1NR)

In yet further various embodiments, well-known mechanisms for reducing noise in a single channel audio signal are implemented. For example, many mechanisms discussed thus far involve the relation of two or more different microphone signals to each other in order to ameliorate wind noise. However, further mechanisms that operate on a single signal may be implemented.

Combinations of Techniques

According to certain aspects, the techniques described above can be combined in a variety of different sequences, depending on the particular application, processing resources, desired performance, etc. Using the acronyms introduced above: OMB, CM, IOB, and 1NR, as well as others introduced below, FIGS. 5-18 disclose a variety of different techniques. Microphones, in various figures, may be identified as OL, IL, OR, or IR, and be numbered. As used in the figures, these acronyms correspond to outer-left, inner-left, outer-right, and inner-right respectively. Such indications show whether a microphone is on the right or left earcup of a headset and is outside the earcup (outer) or inside the earcup/inside the ear (inner). In addition to OMB, CM, IPB, and 1NR, additional techniques, represented by the acronyms: XO, OMBCM, OMBIM, and CM3 are provided.

As used herein, XO refers to a crossover network (whether of physical components or a logical aspect of a signal processor) that divides a signal into frequency bands and/or isolates a single frequency band from others As used herein, OMBCM refers to a combination of an OMB technique and a CM technique as discussed herein.

As used herein, OMBIM refers to an OMB technique followed by a further masking technique different from CM. Specifically, an OMB technique is applied, and estimates for each frequency bin within a frame are made of an amplitude of a speech and an amplitude of noise within the frequency bin within the frame. This output is subjected to a mask that creates a further output with a same spectral content as the estimated speech output. The mask thus causes the output which is noise and speech combined together to have a same amplitude as is estimated for the speech portion alone.

As used herein, CM3 refers to a CM technique with a third input (e.g. output of OMB). The mask generated in connection with a CM technique applied to a first and second input of the CM3 module operates as described above with reference to a CM module, but importantly, is applied to the third input to mitigate wind noise therein. In addition, various techniques include use of filters. As used herein, filter may refer to any analog, digital, time-domain, frequency-domain, software-enabled, discrete component and/or hardware-enabled filtering technology configured to alter the time and/or frequency domain characteristics of a signal.

For ease of reference, these techniques may be referred to as "modules." Such modules may be physical circuits, or may be logical aspects of one or more software process, or may be a combination of hardware and software. Moreover, the words "feed," "feeds," or "feeding" will be used herein below to refer to the provision by a first module of an output signal (based on the inputs to that module) as an input to a second module connected to the first module.

Thus, a system for wind noise mitigation may include a plurality of interconnectable modules. The modules may include at least one comparison masking module configured to perform a method of comparison masking and interconnectable to an optimal mic blending module and one of (a) an input and (b) an output. The modules may also include at least one optimal mic blending module configured to perform a method of optimal microphone blending and interconnectable to the comparison masking module a remaining one of: (a) the input and (b) the output. A received sound signal is provided on the input, and an output sound signal is provided on the output.

Figure 5:
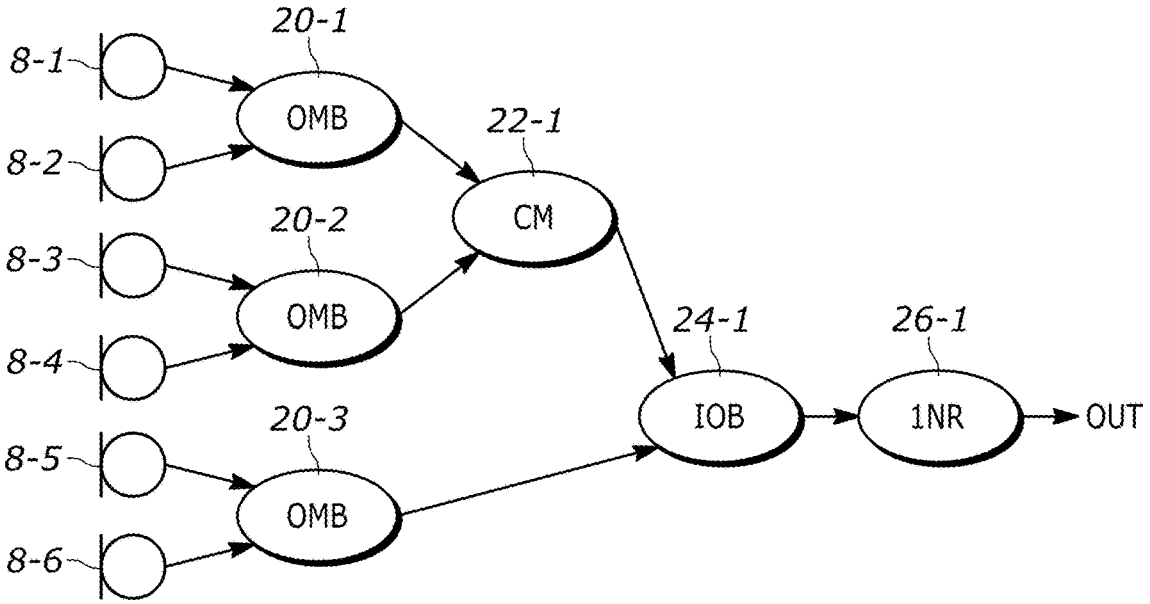
FIGS. 5-18 depict various example combinations of multiple techniques implementable in various systems and methods of wind noise mitigation.

With reference now to FIG. 5, one more specific example technique of interconnecting modules includes a set of six microphones—a first microphone 8-1, a second microphone 8-2, a third microphone 8-3, a fourth microphone 8-4, a fifth microphone 8-5, and a sixth microphone 8-6. The microphones are connected in pairs to OMB modules. For instance, the first microphone and second microphones 8-1, 8-2 are connected to first OMB module 20-1, the third and fourth microphones 8-3, 8-4 are connected to a second OMB module 20-2, and the fifth and sixth microphones 8-5, 8-6 are connected to a third OMB module 20-2. The first OMB module 20-1 and second OMB module 20-2 provide outputs which are both connected to a first CM module 22-1. A first IOB module 24-1 receives outputs from the first CM module 22-1 and the third OMB module 20-3 and provides an output to a first 1NR module 26-1. The first 1NR module 26-1 provides an output signal.

Figure 6:
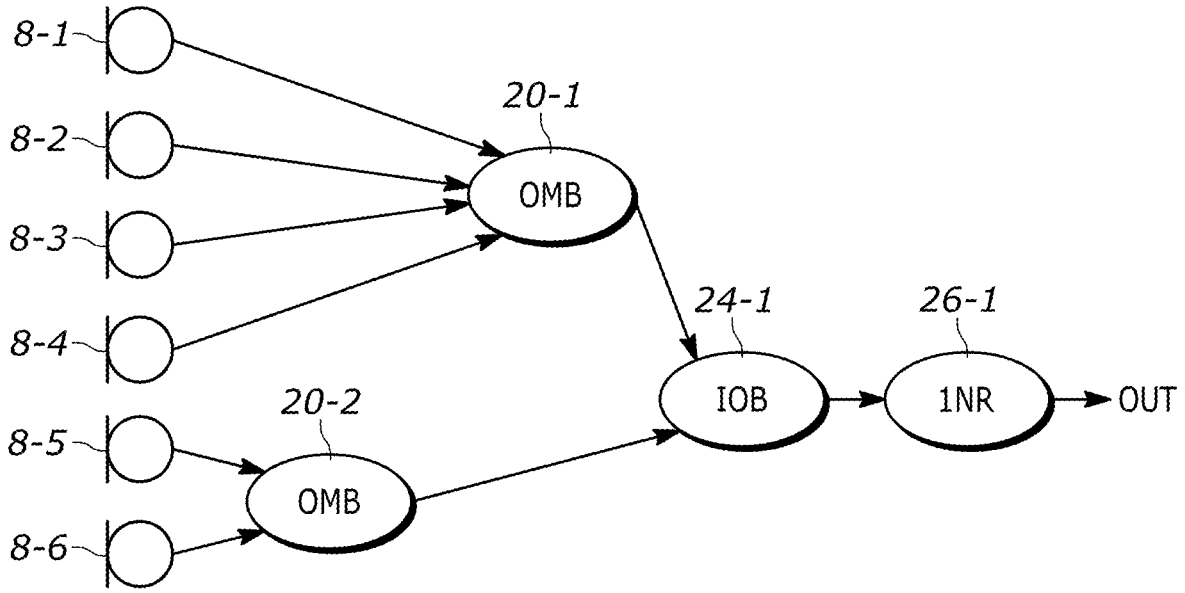

With reference now to FIG. 6, another example techniques includes a set of six microphones—a first microphone 8-1, a second microphone 8-2, a third microphone 8-3, a fourth microphone 8-4, a fifth microphone 8-5, and a sixth microphone 8-6. The first, second, third, and fourth microphones 8-1, 8-2, 8-3, and 8-4 all feed a first OMB module 20-1 and the fifth and sixth microphones 8-5 and 8-6 feed a second OMB module 20-2. The first and second OMB modules 20-1 and 20-2 provide a signal that is received by a first IOB module 24-1, which provides a further signal to a first 1NR module 26-1, which provides an output signal.

Figure 7:
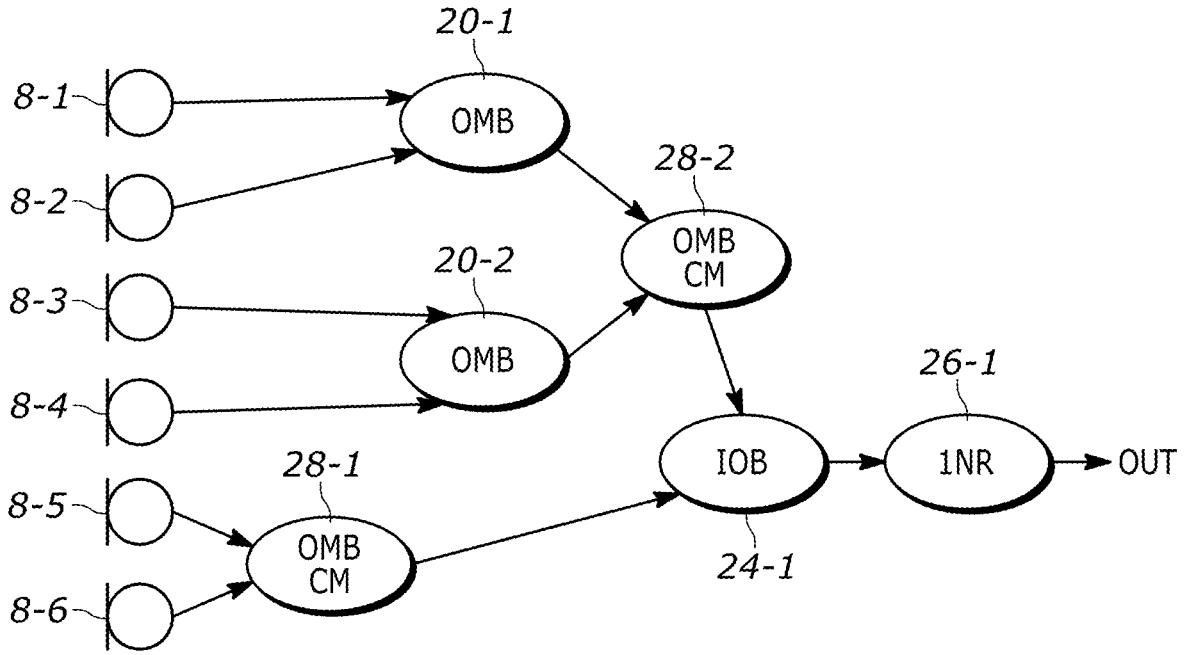

With reference now to FIG. 7, another example technique includes a set of six microphones. In various embodiments, the first and second microphones 8-1 and 8-2 are connected to a first OMB module 20-1 and the third and fourth microphones 8-3 and 8-4 are connected to a second OMB module 20-2. The fifth and sixth microphones 8-5 and 8-6 are connected to a first OMBCM module 28-1. The first and second OMB modules 20-1 and 20-2 are connected to a second OMBCM module 28-2. The first and second OMBCM modules 28-1 and 28-2 are connected to a first IOB module 24-1. The first IOB module 24-1 is connected to a first 1NR module 26-1 which provides an output signal.

Figure 8:
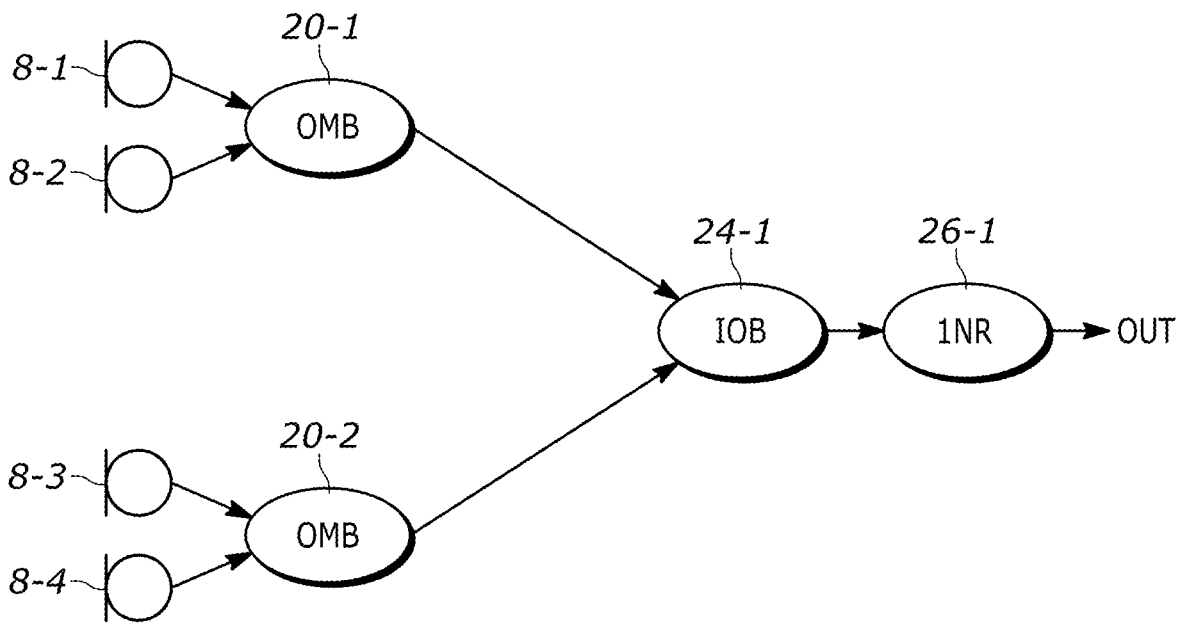

With reference now to FIG. 8, in various embodiments, four microphones are provided. The first and second microphones 8-1 and 8-2 are connected to a first OMB module 20-1. The third and fourth microphones 8-3 and 8-4 are connected to a second OMB module 20-2. The first and second OMB modules 20-1 and 20-2 are connected to a first IOB module 24-1. The first IOB module 24-1 provides a signal to a first 1NR module 26-1 which provides an output signal.

Figure 9:
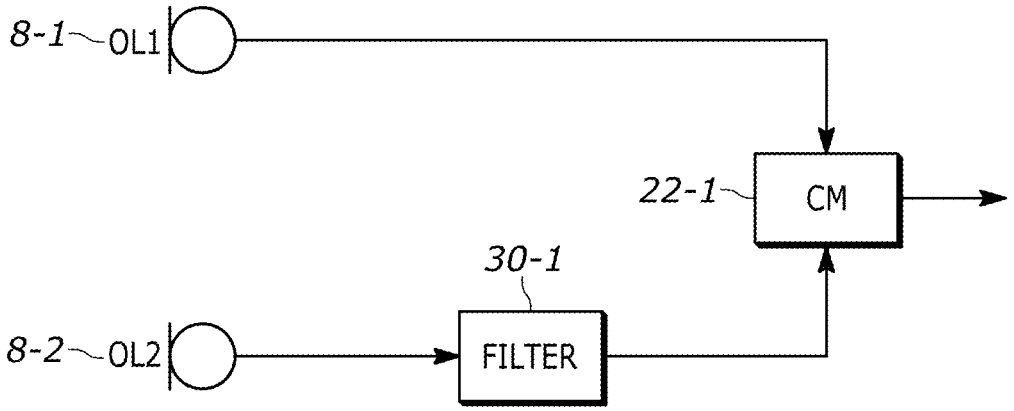

Directing attention now to FIG. 9, various embodiments include a first microphone 8-1, which is a first outer left (OL1) microphone, and a second microphone 8-2, which is a second outer left (OL2) microphone. The second microphone 8-2 feeds a filter 30-1. A first CM module 22-1 receives a signal from the filter 30-1 and the first microphone 8-1 and provides an output signal.

Figure 10:
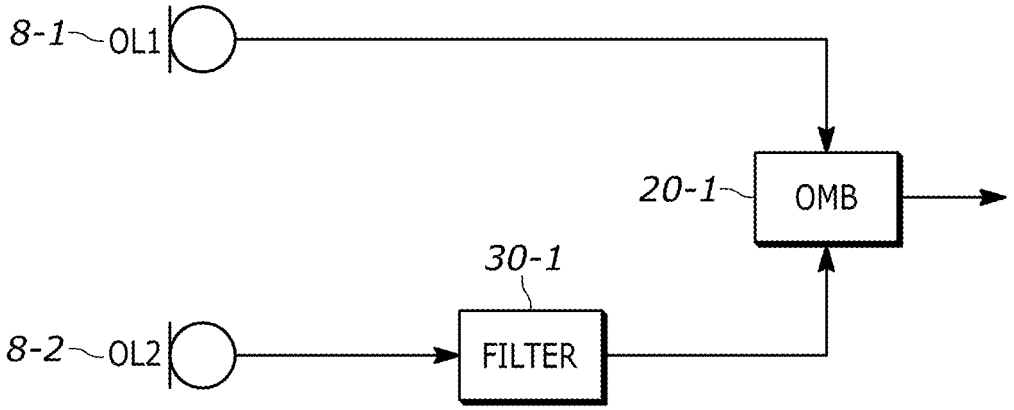

Directing attention now to FIG. 10, various embodiments include a first microphone 8-1, which is a first outer left (OL1) microphone, and a second microphone 8-2, which is a second outer left (OL2) microphone. The second microphone 8-2 feeds a filter 30-1. A first OMB module 20-1 receives a signal from the filter 30-1 and the first microphone 8-1 and provides an output signal.

Figure 11:
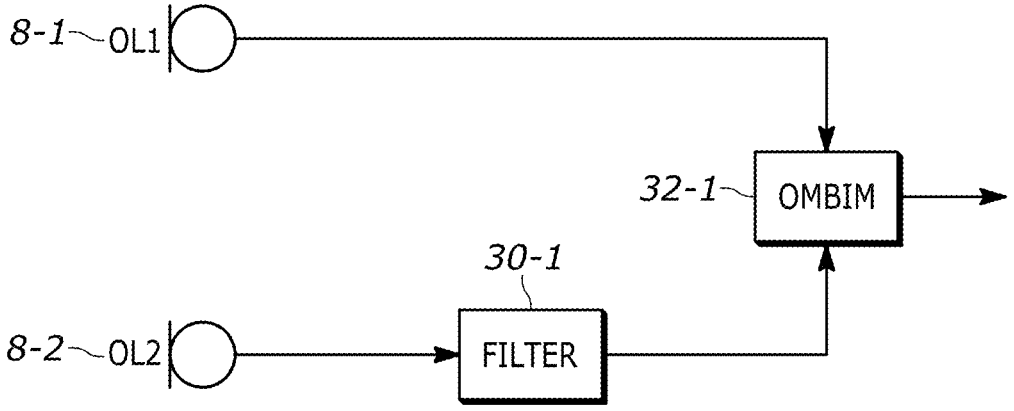

Directing attention now to FIG. 11, various embodiments include a first microphone 8-1, which is a first outer left (OL1) microphone, and a second microphone 8-2, which is a second outer left (OL2) microphone. The second microphone 8-2 feeds a filter 30-1. A first OMBIM module 32-1 receives a signal from the filter 30-1 and the first microphone 8-1 and provides an output signal.

Figure 12:
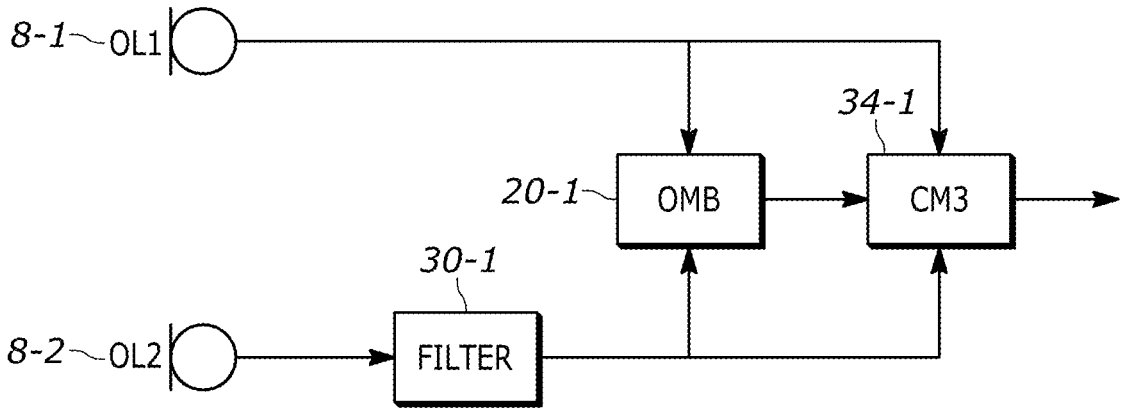

Directing attention now to FIG. 12, various embodiments include a first microphone 8-1, which is a first outer left (OL1) microphone, and a second microphone 8-2, which is a second outer left (OL2) microphone. The second microphone 8-2 feeds a filter 30-1. A first OMB module 30-1 receives a signal from the filter 30-1 and the first microphone 8-1. A first CM3 module 34-1 receives a signal from the first OMB module 30-1, a signal from the first microphone, 30-2, and a signal from the filter 30-1 and provides an output signal.

Figure 13:
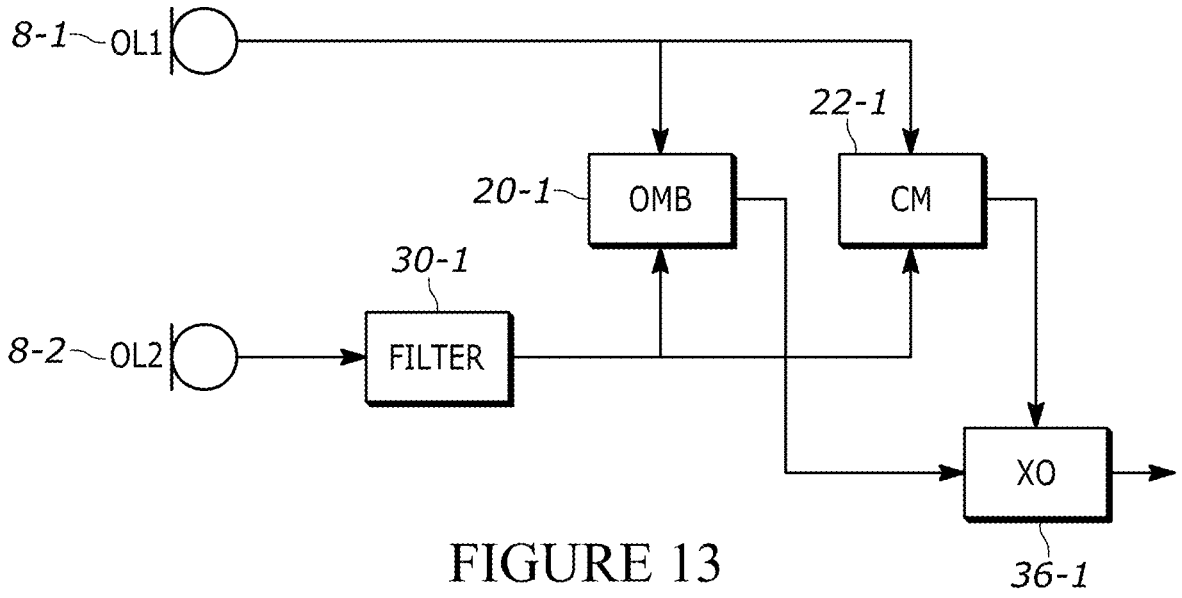

Directing attention now to FIG. 13, various embodiments include a first microphone 8-1, which is a first outer left (OL1) microphone, and a second microphone 8-2, which is a second outer left (OL2) microphone. The second microphone 8-2 feeds a filter 30-1. A first OMB module 20-1 receives a signal from the filter 30-1 and the first microphone 8-1. A first CM module 22-1 receives a signal from the filter 30-1 and the first microphone 8-1. A first XO module 36-1 receives a signal from the first CM module 22-1 and from the first OMB module 20-1 and provides an output signal.

Figure 14:
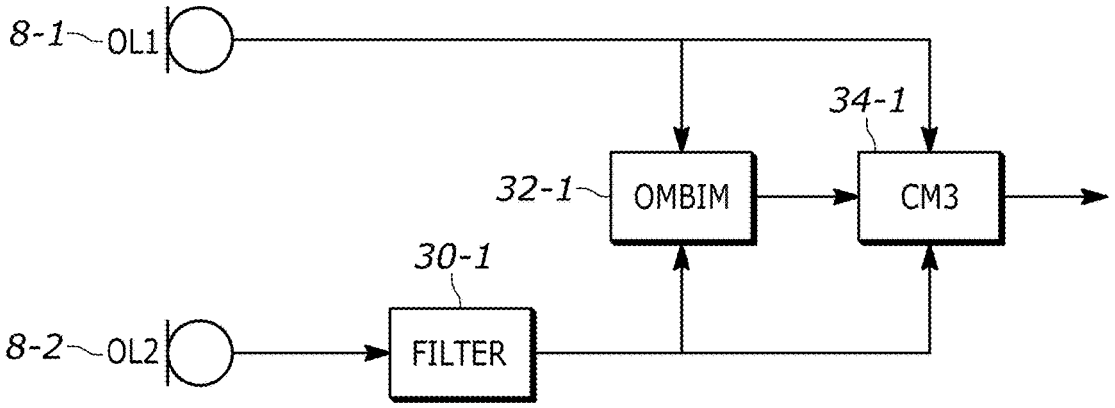

Directing attention now to FIG. 14, various embodiments include a first microphone 8-1, which is a first outer left (OL1) microphone, and a second microphone 8-2, which is a second outer left (OL2) microphone. The second microphone 8-2 feeds a filter 30-1. A first OMBIM module 32-1 receives a signal from the filter 30-1 and the first microphone 8-1. A first CM3 module 34-1 receives a signal from the filter 30-1, a signal from the first microphone 8-1, and a signal from the first OMBIM module 23-1. The first CM3 module 34-1 provides an output signal.

Figure 15:
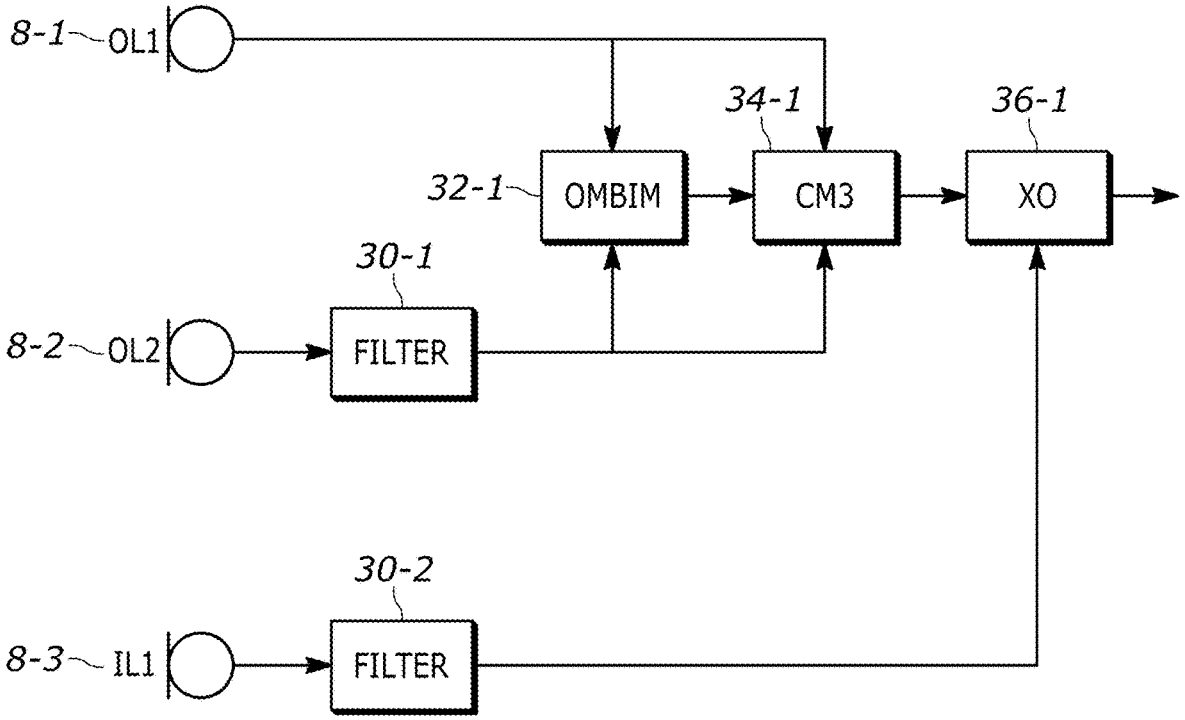

Directing attention now to FIG. 15, various embodiments include a first microphone 8-1, which is a first outer left (OL1) microphone, a second microphone 8-2, which is a second outer left (OL2) microphone, and a third microphone 8-3 which is a first inner left (IL1) microphone. The first microphone 8-1 feeds a first OMBIM module 32-1 and a first CM3 module 34-1. The second microphone 8-2 feeds a first filter 30-1. The third microphone 8-3 feeds a second filter 30-2. The first filter 30-1 feeds the first OMBIM module 32-1 and the first CM3 module 34-1. The second filter 30-2 feeds a first XO module 36-1 as does the first CM3 module 34-1. The first XO module 36-1 provides an output signal.

Figure 16:
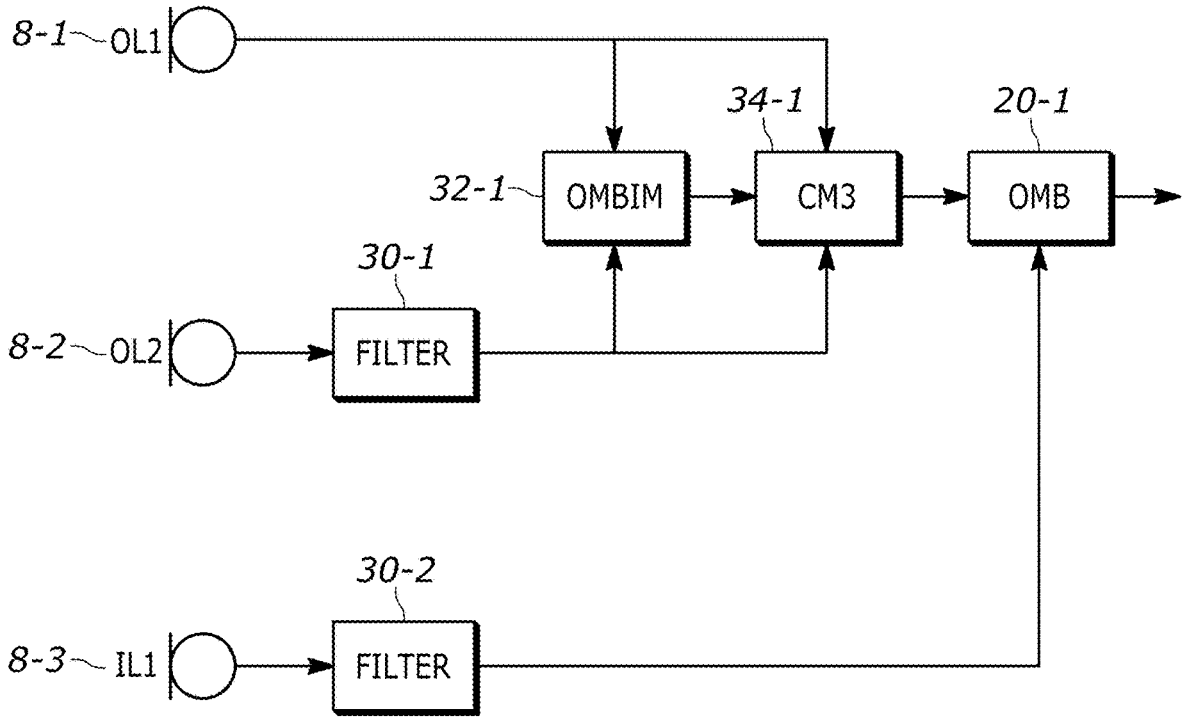

Directing attention now to FIG. 16, various embodiments include a first microphone 8-1, which is a first outer left (OL1) microphone, a second microphone 8-2, which is a second outer left (OL2) microphone, and a third microphone 8-3 which is a first inner left (IL1) microphone. The first microphone 8-1 feeds a first OMBIM module 32-1 and a first CM3 module 34-1. The second microphone 8-2 feeds a first filter 30-1. The third microphone 8-3 feeds a second filter 30-2. The first filter 30-1 feeds the first OMBIM module 32-1 and the first CM3 module 34-1. The second filter 30-2 feeds a first OMB module 20-1 as does the first CM3 module 34-1. The first OMB module 20-1 provides an output signal.

Figure 17:
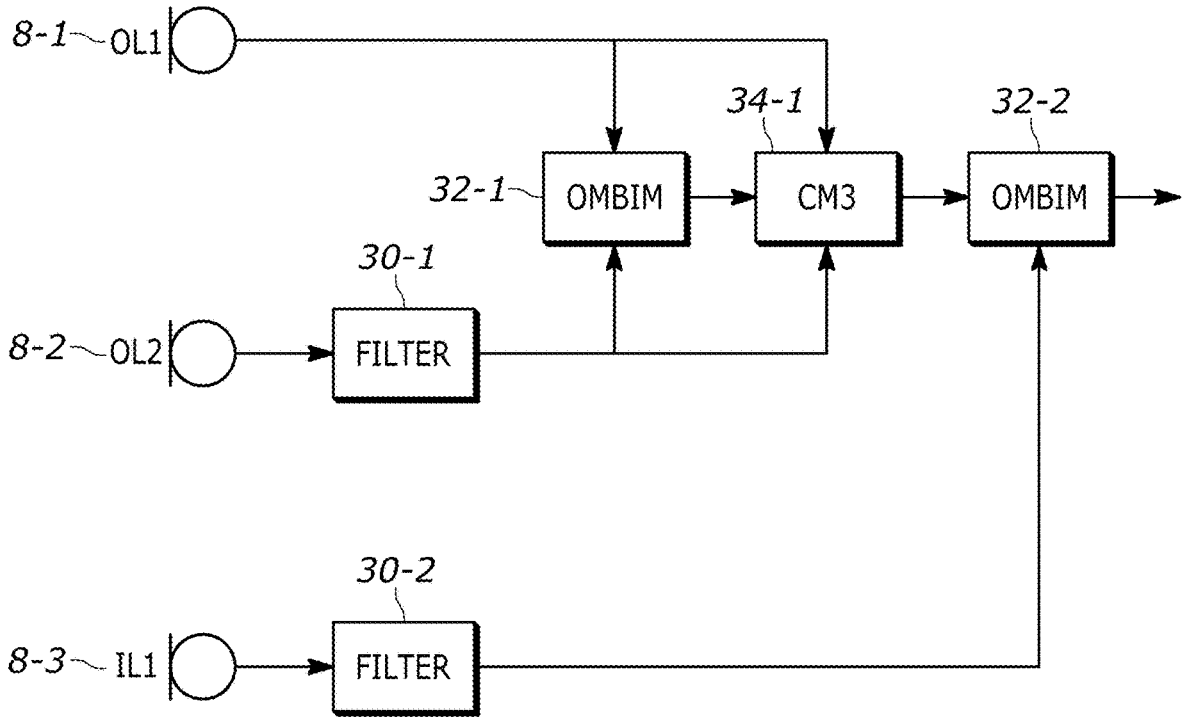

Directing attention now to FIG. 17, various embodiments include a first microphone 8-1, which is a first outer left (OL1) microphone, a second microphone 8-2, which is a second outer left (OL2) microphone, and a third microphone 8-3 which is a first inner left (IL1) microphone. The first microphone 8-1 feeds a first OMBIM module 32-1 and a first CM3 module 34-1. The second microphone 8-2 feeds a first filter 30-1. The third microphone 8-3 feeds a second filter 30-2. The first filter 30-1 feeds the first OMBIM module 32-1 and the first CM3 module 34-1. The second filter 30-2 feeds a second OMBIM module 32-1 as does the first CM3 module 34-1. The first OMBIM module 32-1 provides an output signal.

Figure 18:
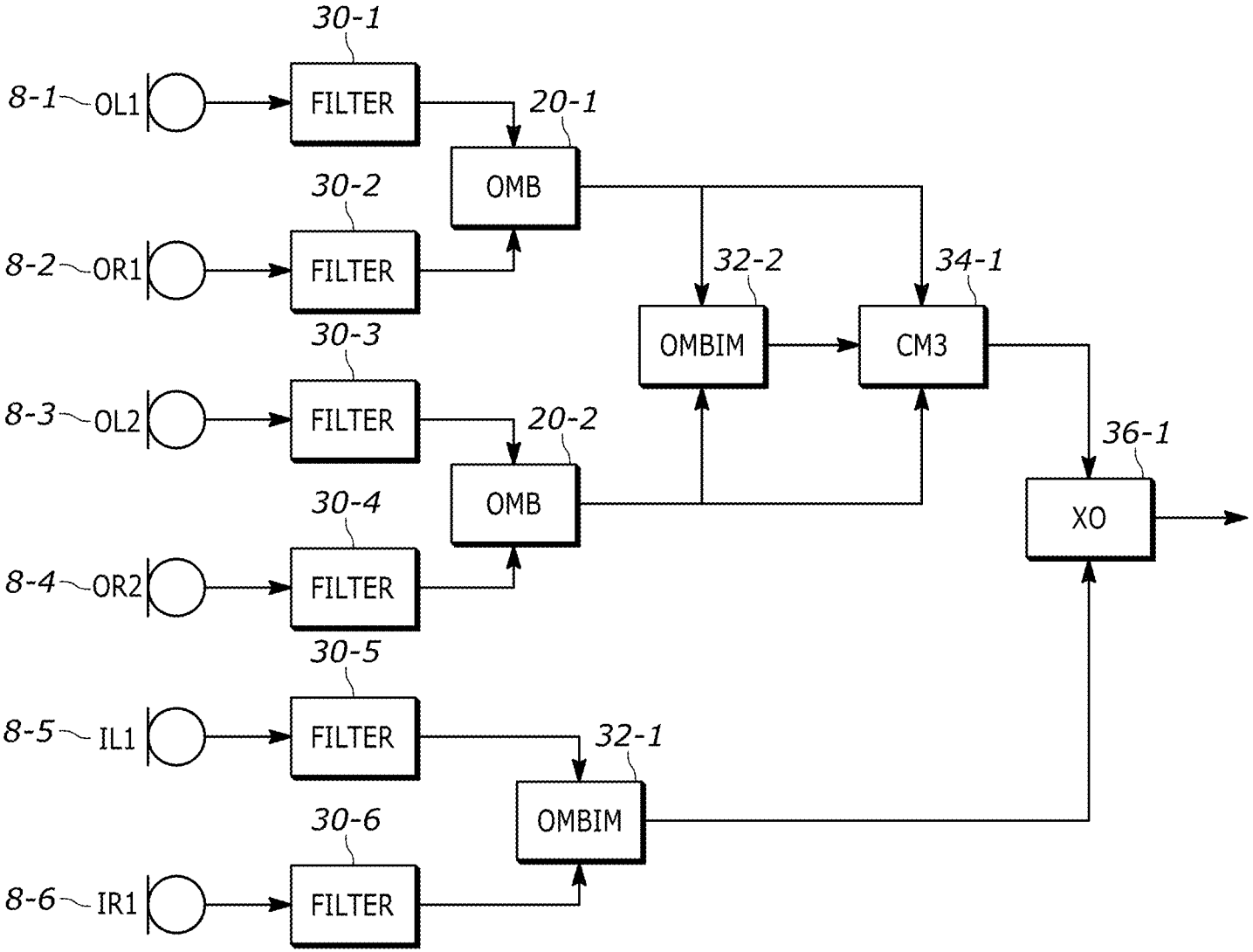

Directing attention now to FIG. 18, various embodiments include six microphones—a first microphone 8-1, a second microphone 8-2, a third microphone 8-3, a fourth microphone 8-4, a fifth microphone 8-5, and a sixth microphone 8-6. Each microphone feeds a corresponding filter. The first microphone 8-1 is a first outer left microphone (OL1), the second microphone 8-2 is a first outer right microphone (OR1), the third microphone 8-3 is a second outer left microphone (OL2), the fourth microphone 8-4 is a second outer right microphone (OR2), the fifth microphone 8-5 is a first inner left microphone (IL1), and the sixth microphone 8-6 is a first inner right microphone (IR1). The first microphone 8-1 feeds a first filter 30-1, the second microphone 8-2 feeds a second filter 30-2, the third microphone 8-3 feeds a third filter 30-3, the fourth microphone 8-4 feeds a fourth filter 30-4, the fifth microphone 8-5 feeds a fifth filter 30-5, and the sixth microphone 8-6 feeds a sixth filter 30-6. The first filter 30-1 and the second filter 30-2 feed a first OMB module 20-1. The third filter 30-3 and the fourth filter 30-4 feed a second OMB module 20-2. The fifth filter 30-5 and the sixth filter 30-6 feed a first OMBIM module 32-1. The first OMB module 20-1 feeds a second OMBIM module 32-2 and a first CM3 module 34-1. The second OMB module 20-2 feeds the second OMBIM module 32-2 and the first CM3 module 34-1. The second OMBIM module 32-2 also feeds the first CM3 module 34-1. The first OMBIM module 32-1 and the first CM3 module 34-1 both feed an XO module 36-1, which provides an output signal.

As used herein, the singular terms "a," "an," and "the" may include plural references unless the context clearly dictates otherwise. Additionally, amounts, ratios, and other numerical values are sometimes presented herein in a range format. It is to be understood that such range format is used for convenience and brevity and should be understood flexibly to include numerical values explicitly specified as limits of a range, but also to include all individual numerical values or sub-ranges encompassed within that range as if each numerical value and sub-range is explicitly specified.

While the present disclosure has been described and illustrated with reference to specific embodiments thereof, these descriptions and illustrations do not limit the present disclosure. It should be understood by those skilled in the art that various changes may be made and equivalents may be substituted without departing from the true spirit and scope of the present disclosure as defined by the appended claims. The illustrations may not be necessarily drawn to scale. There may be distinctions between the artistic renditions in the present disclosure and the actual apparatus due to manufacturing processes and tolerances. There may be other embodiments of the present disclosure which are not specifically illustrated. The specification and drawings are to be regarded as illustrative rather than restrictive. Modifications may be made to adapt a particular situation, material, composition of matter, method, or process to the objective, spirit and scope of the present disclosure. All such modifications are intended to be within the scope of the claims appended hereto. While the methods disclosed herein have been described with reference to particular operations performed in a particular order, it will be understood that these operations may be combined, sub-divided, or re-ordered to form an equivalent method without departing from the teachings of the present disclosure. Accordingly, unless specifically indicated herein, the order and grouping of the operations are not limitations of the present disclosure.

The invention claimed is:

1. A multi-stage comparison masking method of noise mitigation comprising:

sampling a sound signal from a plurality of microphones to generate a frame comprising a plurality of time-frequency tiles of the sound signal, each time-frequency tile including respective values of at least one feature from the plurality of microphones;

comparing the respective values of the at least one feature to determine whether each time-frequency tile satisfies a similarity threshold, and flagging each time-frequency tile as noise if it fails to satisfy the similarity threshold;

grouping the plurality of time-frequency tiles into sets of frequency-adjacent time-frequency tiles; and for each set of frequency-adjacent time-frequency tiles in the frame:

counting a number of flagged time-frequency tiles, and attenuating all of the time-frequency tiles in the each set if the number exceeds a noise bin count threshold to thereby reduce noise in the sound signal.

2. The multi-stage comparison masking method according to claim 1, wherein the at least one feature comprises an amplitude or a phase angle.

3. The multi-stage comparison masking method according to claim 2, further comprising performing a fast Fourier transform (FFT) on the samples of the sound signal to generate the amplitude and the phase angle of each time-frequency tile in the frame.

4. The multi-stage comparison masking method according to claim 3, wherein each time-frequency tile corresponds to an FFT frequency bin.

5. The multi-stage comparison masking method according to claim 2, wherein the at least one feature comprises the amplitude, and wherein the similarity threshold is about 3 dB.

6. The multi-stage comparison masking method according to claim 2, wherein the at least one feature comprises the phase, and wherein the similarity threshold is about 15 degrees.

7. The multi-stage comparison masking method according to claim 1, wherein grouping includes:

identifying a first time-frequency tile having a first frequency that is about one octave higher than a second frequency of a second time-frequency tile and about one octave lower than a third frequency of a third time-frequency tile;

grouping frequency-adjacent time-frequency tiles having frequencies between the first and third frequencies into a first set of frequency-adjacent time-frequency tiles; and grouping frequency-adjacent time-frequency tiles having frequencies between the first and second frequencies into a second set of frequency-adjacent time-frequency tiles.

8. The multi-stage comparison masking method according to claim 1, further comprising second comparing the at least one feature of each time-frequency tile from the frame with the at least one feature of the each time-frequency tile from another frame, wherein flagging is further performed based on the second comparing.

9. The multi-stage comparison masking method according to claim 1, further comprising:

forming a first processed sound signal frame based on the attenuating;

second processing the sound signal from a second plurality of microphones to generate a second processed sound signal frame; and third processing the first and second processed sound signal frames to generate a wind noise reduced output sound signal.

10. The multi-stage comparison masking method according to claim 9, wherein the plurality of microphones are all one of in-ear microphones or out-of-ear microphones and the second plurality of microphones are all the other of in-ear microphones or out-of-ear microphones, and wherein the third processing includes inside/outside blending processing.

* * * * *